US006019054A

United States Patent [19]

Hattori et al.

[11] Patent Number: 6,019,054

[45] **Date of Patent: *Feb. 1, 2000**

[54] CUSHIONING APPARATUS FOR SMALL WATERCRAFT

[75] Inventors: Toshiyuki Hattori; Nobuharu Ohta; Mitsutaka Nakamura, all of Shizuoka, Japan

[73] Assignee: Yamaha Hatsudoki Kabushiki Kaisha, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/789,765

[22] Filed: Jan. 27, 1997

[30] Foreign Application Priority Data

Jan. 26, 1996 [JP] Japan ..... 8-011921

[51] Int. Cl.[7] ..... B63B 35/00

[52] U.S. Cl. ..... 114/55.57; 114/55.5

[58] Field of Search ..... 114/144 R, 270, 114/363, 55.5, 55.55; 440/38; 74/551.1, 551.2; 280/276

[56] References Cited

U.S. PATENT DOCUMENTS

| | | |
|---|---|---|
| 2,561,156 | 7/1951 | Thorkildsen . |
| 4,896,559 | 1/1990 | Marier et al. . |
| 5,097,789 | 3/1992 | Oka . |
| 5,255,626 | 10/1993 | Hattori et al. . |
| 5,309,861 | 5/1994 | Mardikian . |
| 5,367,978 | 11/1994 | Mardikian . |
| 5,390,621 | 2/1995 | Hattori et al. . |
| 5,490,474 | 2/1996 | Ikeda . |
| 5,542,371 | 8/1996 | Harvey et al. . |
| 5,542,862 | 8/1996 | Kobayashi . |
| 5,622,132 | 4/1997 | Mardikian ..... 114/270 |

*Primary Examiner*—Ed Swinehart

*Attorney, Agent, or Firm*—Knobbe, Martens, Olson & Bear LLP

[57] ABSTRACT

A cushioning apparatus provides an improved on a watercraft in order to improve the comfort of the ride, to reduce rider fatigue and to cushion impact forces experienced by the watercraft hull. The cushioning apparatus absorbs at least a portion of any impact force which the rider experienced from the hull, as well as provides a degree of movement between the rider and the hull in order to cushion such impact forces. The cushioning apparatus may also isolate the rider, at least to some degree, from vibrations experienced by the hull.

48 Claims, 19 Drawing Sheets

CUSHIONING APPARATUS FOR SMALL WATERCRAFT

BACKGROUND OF THE INVENTION

1. Field of the Invention

The present invention relates in general to a small watercraft, and in particular to a shock-absorbing apparatus for a small watercraft.

2. Description of Related Art

Personal watercrafts have become popular in recent years. This type of watercraft is sporting in nature; it turns swiftly, is easily maneuverable, and accelerates quickly. Personal watercraft today commonly carrier one rider and one or two passengers.

A relatively light weight, small hull of the personal watercraft defines an engine compartment below a rider's area. An internal combustion engine frequently lies within the engine compartment in front of a tunnel formed on the underside of the watercraft hull. The internal combustion engine commonly powers a jet propulsion device located within the tunnel. An impeller shaft commonly extends between the engine and the propulsion device for this purpose. Such small watercraft today are capable of traveling at high rates of speed.

Riders often experience noticeable vibrations, shocks and bumps as the relatively light-weight small hull travels quickly across a body of water. These jarring movements are acerbated as the watercraft meets waves and wakes on the water. The resultant rough ride contributes to rider fatigue.

Many riders also jump their watercraft off of wakes and waves. The landing, however, severely jars the rider, especially if the watercraft lands bow first. The rider conventionally must absorb all of the impact by using his or her legs and arms.

SUMMARY OF THE INVENTION

In order to improve the comfort of the ride, to reduce rider fatigue and to cushion impact forces experienced by the watercraft hull, a cushioning apparatus is provided on a watercraft. The cushioning apparatus absorbs at least a portion of any impact force which the rider experienced from the hull, as well as provides a degree of movement between the rider and the hull in order to cushion such impact forces. The cushioning apparatus may also isolate the rider, at least to some degree, from vibrations experienced by the hull.

One aspect of the present invention thus involves a small watercraft comprising a hull formed at least in part by an upper deck portion and a lower hull portion. A steering operator of the watercraft is coupled to a steering column and is rotatable about a steering axis. A cushioning apparatus is arranged between the steering operator and the hull to support the steering operator on the hull. The cushioning apparatus includes at least a first member and a second member. The second member is movable relative to the first member along a travel path that is generally parallel to the steering axis so as to absorb a portion of any impact force applied to the steering operator.

Another aspect of the present invention involves a small watercraft comprising a hull. A steering operator is coupled to a steering column of the watercraft. A shock absorber is arranged between the steering operator and the hull to support the steering operator on the hull. The shock absorber absorbs any impact force applied to the steering operator through the hull.

In accordance with an additional aspect of the present invention, a small watercraft comprises a substantially enclosed hull formed principally by a lower hull portion and an upper deck. A rider assembly is positioned on the hull. The rider assembly includes a steering operator and a seat positioned behind the steering operator. A suspension system supports the rider assembly on the hull. The suspension system includes a cushioning means for reducing impact forces transferred from the hull to the rider assembly. The cushioning means is arranged to operate between the steering operator and the hull.

BRIEF DESCRIPTION OF THE DRAWINGS

These and other features of the invention will now be described with reference to the drawings of preferred embodiments which are intended to illustrate and not to limit the invention, and in which.

DETAILED DESCRIPTION OF PREFERRED EMBODIMENTS OF THE INVENTION

Figure 1:
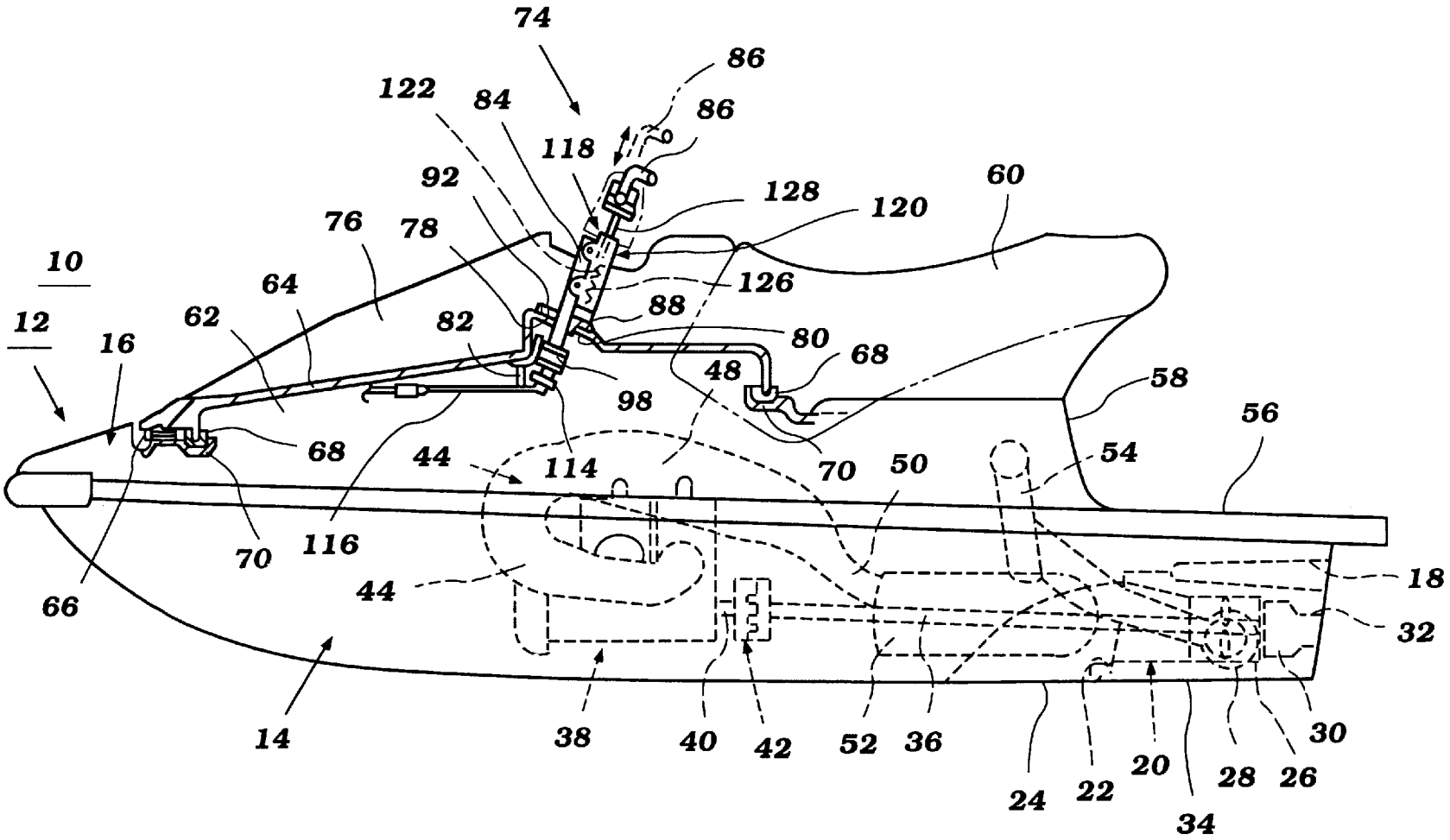
FIG. 1 is a partial sectional side elevational view of a personal watercraft including a cushioning apparatus configured in accordance with a preferred embodiment of the present invention.

Several embodiments of an exemplary watercraft with a cushioning apparatus are disclosed herein. Each of these embodiments employ the same basic concepts characteristic of the improved features of the cushioning apparatus, namely a system for reducing a rough ride experienced by a rider. The cushioning apparatus provides at least one degree of freedom to the steering operator, and in some embodiments, the cushioning apparatus provides one or more degrees of freedom to a rider assembly on which the entire rider rides. The cushioning apparatus also absorbs at least a portion of any impact experienced by the hull during riding. The cushioning apparatus also can essentially decouple the rider from vibrations experienced by the watercraft hull.

The present cushioning apparatus has particular utility for use with personal watercraft, and thus, the following describes the cushioning apparatus in the context of a personal watercraft. This environment of use, however, is merely exemplary. The present cushion apparatus can be readily adapted by those skilled in the art for use with other types of watercraft as well, such as, for example, but without limitation, small jet boats and the like.

With initial reference to the embodiment illustrated in FIGS. 1-4, the watercraft 10 includes a hull 12 that is formed by a lower hull section 14 and an upper deck section 16. The hull sections 14, 16 are formed of a suitable material such as, for example, a molded fiberglass reinforced resin. The lower hull section 14 and the upper deck section 16 are fixed to each other around the peripheral edges in any suitable manner.

The lower hull 14 is designed such that the watercraft 10 planes or rides on a minimum surface area of the aft end of the lower hull 14 in order to optimize the speed and handling of the watercraft 10 when up on plane. For this purpose, the lower hull section generally has a V-shaped configuration formed by a pair of inclined section that extend outwardly from the keel line to outer chines at a dead rise angle. The inclined sections extend longitudinally from the bow toward the transom of the lower hull 14 and extend outwardly to side walls of the lower hull. The side walls are generally flat and straight near the stem of the lower hull and smoothly blend towards the longitudinal center of the watercraft at the bow. The lines of intersection between the inclined section and the corresponding side wall form the outer chines of the lower hull section.

Toward the transom of the watercraft, the incline sections of the lower hull extend outwardly from a recessed channel or tunnel 18 that extends upward toward the upper deck portion 16. The tunnel 18 has a generally parallelepiped shape and opens through the rear of the transom of the watercraft 10, as understood from FIG. 1.

In the illustrated embodiment, a jet pump unit 20 propels the watercraft 10. The jet pump unit 20 is mounted within the tunnel 18 formed on the underside of the lower hull section 14 by a plurality of bolts. An intake duct 22 of the jet pump unit 20 defines an inlet opening 24 that opens into a gullet of the duct. The duct gullet leads to an impeller housing 26 in which the impeller 28 of the jet pump 20 operates. An impeller duct assembly, which acts as a pressurization chamber, delivers the water flow from the impeller housing 26 to a discharge nozzle housing 30.

A steering nozzle 32 is supported at the downstream end of the discharge nozzle by a pair of vertically extending pivot pins. In an exemplary embodiment, the steering nozzle 32 has an integral lever on one side.

A ride plate 34 covers a portion of the tunnel 18 behind the inlet opening 24 to enclose the pump chambers and the nozzle assembly 30 within the tunnel 18. In this manner, the lower opening of the tunnel 18 is closed to provide in part a planing surface for the watercraft.

An impeller shaft 36 supports the impeller 28 within the impeller housing 26. The aft end of the impeller shaft 36 is suitably supported and journalled within the compression chamber in a known manner. The impeller shaft 36 extends in the forward direction through a front wall of the tunnel 18.

The lower hull portion 14 principally defines the engine compartment. Except for some conventional air ducts, the engine compartment is normally substantially sealed so as to enclose an engine and the fuel system of the watercraft 10 from the body of water in which the watercraft is operated.

An internal combustion engine 38 of the watercraft powers the impeller shaft 36 to drive the impeller 28 of the jet pump unit 20. The engine 38 is positioned within the engine compartment and is mounted centrally within the hull 12. Vibration-absorbing engine mounts secure the engine 38 to the lower hull portion 14 in a known manner.

In the illustrated embodiment, the engine 38 includes two in-line cylinders and operates on a two-stroke, crankcase compression principle. The engine 38 is positioned such that the row of cylinders lies parallel to a longitudinal axis of the watercraft 10, running from bow to stern. This engine type, however, is merely exemplary. Those skilled in the art will readily appreciate that the present fuel delivery system can be used with any of a variety of engine types having other number of cylinders, having other cylinder arrangements and operating on other combustion principles (e.g., four-stroke principle).

A cylinder block and a cylinder head assembly desirably form the cylinders of the engine. A piston reciprocates within each cylinder of the engine 38 and together the pistons drive an output shaft 40, such as a crankshaft, in a known manner. A connecting rod links the corresponding piston to the crankshaft 40. The corresponding cylinder bore, piston and cylinder head of each cylinder forms a variable-volume chamber, which at a minimum volume defines a combustion chamber.

The crankshaft 40 desirably is journalled with a crankcase, which in the illustrated embodiment is formed between a crankcase member and a lower end of the cylinder block. Individual crankcase chambers of the engine are formed within the crankcase by dividing walls and sealing disks, and are sealed from one another with each crankcase chamber communicating with a dedicated variable-volume chamber. Each crankcase chamber also communicates with a charge former of an induction system through a check valve (e.g., a reed-type valve). The induction system receives fuel from a fuel tank, which is positioned within the hull 12, and produces the fuel charge which is delivered to the cylinders in a known manner. Because the internal details of the engine 38 and the induction system desirably are conventional, a further description of the engine construction is not believed necessary to understand and practice the invention.

As seen in FIG. 1, a coupling 42 interconnects the engine crankshaft 40 to the impeller shaft 36. A bearing assembly (not shown), which is secured to the bulkhead, supports the impeller shaft 36 behind the shaft coupling 42.

An exhaust system 44 is provided to discharge exhaust byproducts from the engine 38 to the atmosphere and/or to the body of water in which the watercraft 10 is operated. The exhaust system 44 includes an exhaust manifold that is affixed to the side of the cylinder block and which receives exhaust gases from the variable-volume chambers through exhaust ports in a well-known manner.

An outlet end of the exhaust manifold communicates with a C-shaped pipe section 46. This C-pipe 46 includes an inner tube that communicates directly with the discharge end of the exhaust manifold. An outer tube surrounds the inner tube to form a coolant jacket between the inner and outer tubes. Although not illustrated, the C-pipe 46 includes an inlet port positioned near its inlet end. The inlet port communicates with a water jacket of the engine 38.

The outlet end of the C-pipe 46 communicates with an expansion chamber 48. In the illustrated embodiment, the expansion chamber has a tubular shape in which an expansion volume is defined within an annular, thick wall. Coolant jacket passages extend through the expansion chamber wall and communicate with the coolant jacket of the C-pipe 46.

A flexible coupling connects the outlet end of the C-pipe 46 to the inlet end of the expansion chamber 48. The flexible coupling also can include an outlet port which communicates with an internal coolant passage within the flexible coupling. The coolant passage places the coolant jacket and the coolant passages in communication.

The outlet end of the expansion chamber 48 is fixed to a reducer pipe which tapers in diameter toward its outlet. The pipe has a dual shell construction formed by an inner shell which defines an exhaust flow passage. The expansion volume communicates with this passage.

An outer shell is connected to the inner shell and defines a cooling jacket about the inner shell of the reducer pipe. The coolant jacket passages of the expansion chamber communicate with the coolant jacket of the pipe to discharge a portion of the coolant with the exhaust gases.

A catalyzer can be disposed within the space defined at the mating ends of the expansion chamber and the reducer pipe. For instance, the catalyzer can include an annular shell supporting a honeycomb-type catalyst bed. The catalyst bed is formed of a suitable catalytic material such as that designed to treat and render harmless hydrocarbons, carbon monoxide, and oxides of nitrogen. An annular flange supports the annular shell generally at the center of the flow path through the expansion chamber volume. In this manner, all exhaust gases, which flow through the expansion chamber 48, pass through the catalyst bed. The annular flange can be held the between outlet end of the expansion chamber and the inlet end of the reducer pipe.

The lower section of the reducer pipe includes a downwardly turned portion that terminates at the discharge end. The inner shell stops short of the outer shell such that the water flow through the water jacket merges with the exhaust gas flow through the exhaust passage at the discharge end.

A flexible pipe 50 is connected to the discharge end of the reducer pipe and extends rearward along one side of the watercraft hull tunnel 18. The flexible conduit 50 connects to an inlet section of a water trap device 52. The water trap device 52 also lies within the watercraft hull 12 on the same side of the tunnel 18.

The water trap device 52 has a sufficient volume to retain water and to preclude the back flow of water to the expansion chamber 48 and the engine 38. Internal baffles within the water trap device 52 help control water flow through the exhaust system 44.

An exhaust pipe 54 extends from an outlet section of the water trap device 52 and wraps over the top of the tunnel 18 to a discharge end. The discharge end desirably opens into the tunnel 18 at an area that is close to or actually below the water level with the watercraft 10 floating at rest on the body of water.

The personal watercraft 10 so far described represents only an exemplary watercraft on which the present cushioning apparatus can be employed. A further description of the personal watercraft 10 is not believed necessary for an understanding and an appreciation of the present invention. The cushioning apparatus and its arrangement on the upper deck 16 will now be described in detail.

As best understood from FIG. 1, the upper deck 16 and the lower hull portion 14 together define a pair of raised gunnels 56 positioned on opposite sides of the aft end of the upper deck assembly 16. The raised gunnels 56 define a pair of foot areas that extend generally longitudinally and parallel to the sides of the watercraft 10. In this position, the operator and any passengers sitting on the watercraft 10 can place their feet in the foot areas with the raised gunnels 56 shielding the feet and lower legs of the riders. A non-slip (e.g., rubber) mat desirably covers the foot areas to provide increased grip and traction for the operator and the passengers.

Toward the aft end of the watercraft, a seat pedestal 58 rises above the foot areas. The pedestal 58 supports a seat cushion 60 to form a seat assembly. In the illustrated embodiment, the seat assembly has a longitudinally extending straddle-type shape which may be straddled by an operator and by at least one or two passengers. For this purpose, the raised pedestal 58 has an elongated shape and extends longitudinally along the center of the watercraft 10. The seat cushion 60 desirably is removably attached to the pedestal 58 by a quick-release latching assembly, as known in the art.

An access opening 62 is defined in the upper deck 16 in front of the raised pedestal 58. The access opening 62 opens into an engine compartment formed within the hull 12. A lid 64 normally covers the access opening 62 to enclose the engine compartment.

A conventional latch or similar mechanism 66 releasably secures the lid 64 to the upper deck 16. In the illustrated embodiment, the latch 66 is located on the front side of the lid 64.

A seal 68 extends about the peripheral edge of the lid 64. The seal 68 sits within a lip 70 that surrounds the access opening 62 and is compressed against the lip 70 when the latch 66 secures the lid 64 to the upper deck 16. In this manner, the lid 64 generally seals the access opening 62 closed.

With the lid 64 attached to the upper deck 16, the lid 64 and upper deck 16 together define a bow portion that slopes upwardly toward a control mast 74. Although not illustrated, the bow portion desirably includes at least one air duct through which air can enter the hull 12. A cover (not shown) extends above an upper end of the air duct to inhibit an influx of water into the hull 12.

In the illustrated embodiment, a bow molding 76 is attached to the upper side of the lid 64. The bow molding 76 tapers upward from a point near the bow toward the control mast 74 to improve the aesthetics of the watercraft 10.

The lid 64 includes an inclined platform 78 which assists the support of the control mast 74 and is the support from which the control mast 74 extends. In the illustrated embodiment, at least a portion of the control mast 74 extends through a hole 80 formed in the lid's inclined platform 78. As seen in FIG. 1, the inclined platform 78 slopes downward toward the stem of the watercraft 10. As such, the control mast 74 projects upward at a rearward angle toward the rider's seat 60 on the watercraft 10.

As seen in FIG. 1, a bearing support plate 82 lies below and just forward of the hole 80 in the lid platform 78. The bearing support plate 82 in this position assists with securing the control mast 74 to the watercraft hull 10. In the illustrated embodiment, the support plate 82 is attached to an inner surface of the lid 64; however, the support plate 82 can be attached to the upper deck 16 and/or to the lower hull portion 14. Additional supports also can be used to bolster the support plate 82 below the lid 64.

The control mast 74 includes a steering column 84 that supports a steering operator 86. In the illustrated embodiment, the steering operator is a handlebar assembly; however, other steering operators, such as, for example, a steering wheel or a control stick (i.e., joystick), also can be used.

A pair of bearing assemblies journal a lower end of the steering column 84 within the hull 12. The bearings' support allows the steering column 84 to extend above the lid 64 and to be rotated about a steering axis which coincides with a longitudinal axis of the column 84.

Figure 2:
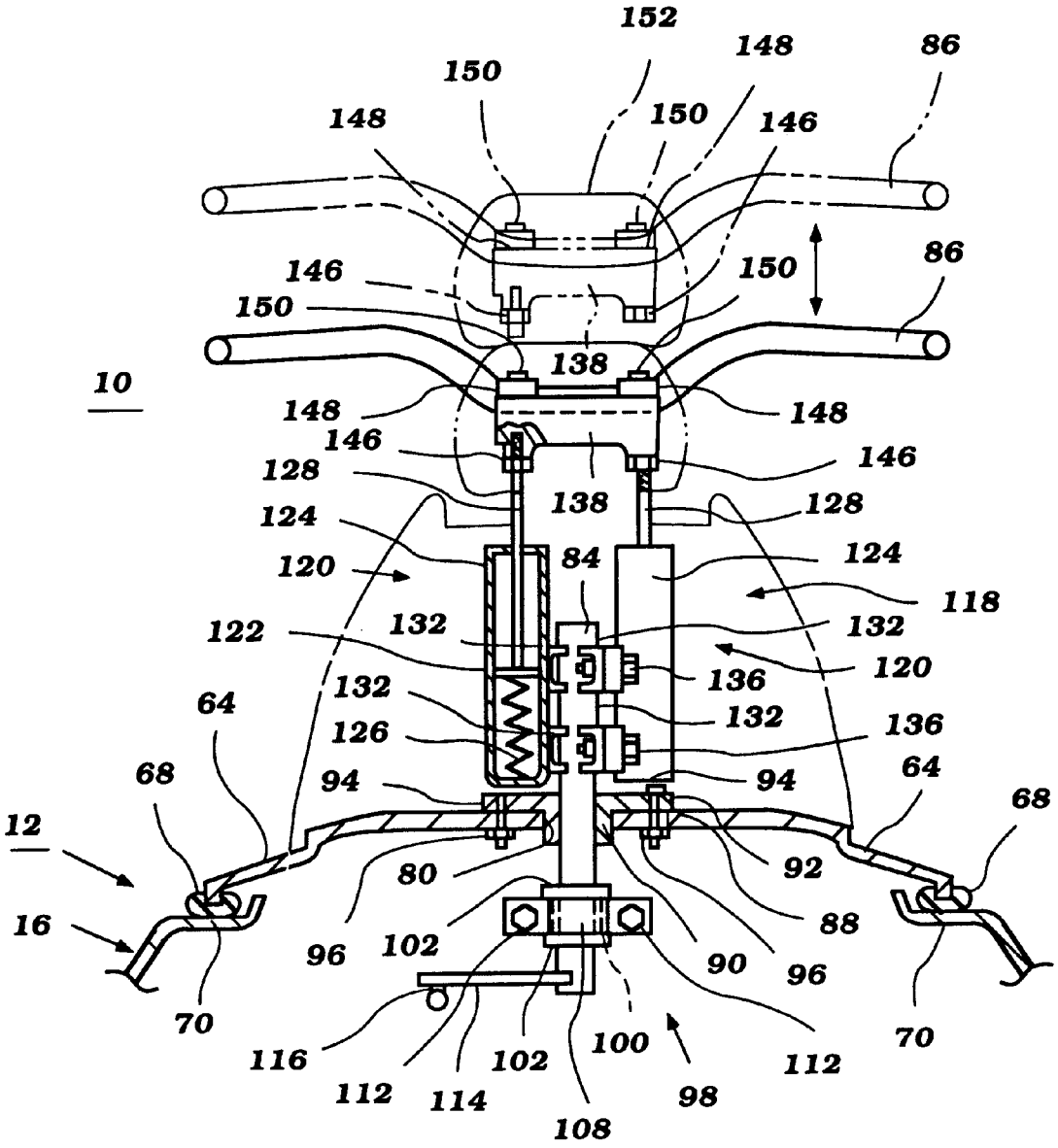
FIG. 2 is a partial sectional front elevational view of the cushioning apparatus of FIG. 1.
Figure 4:
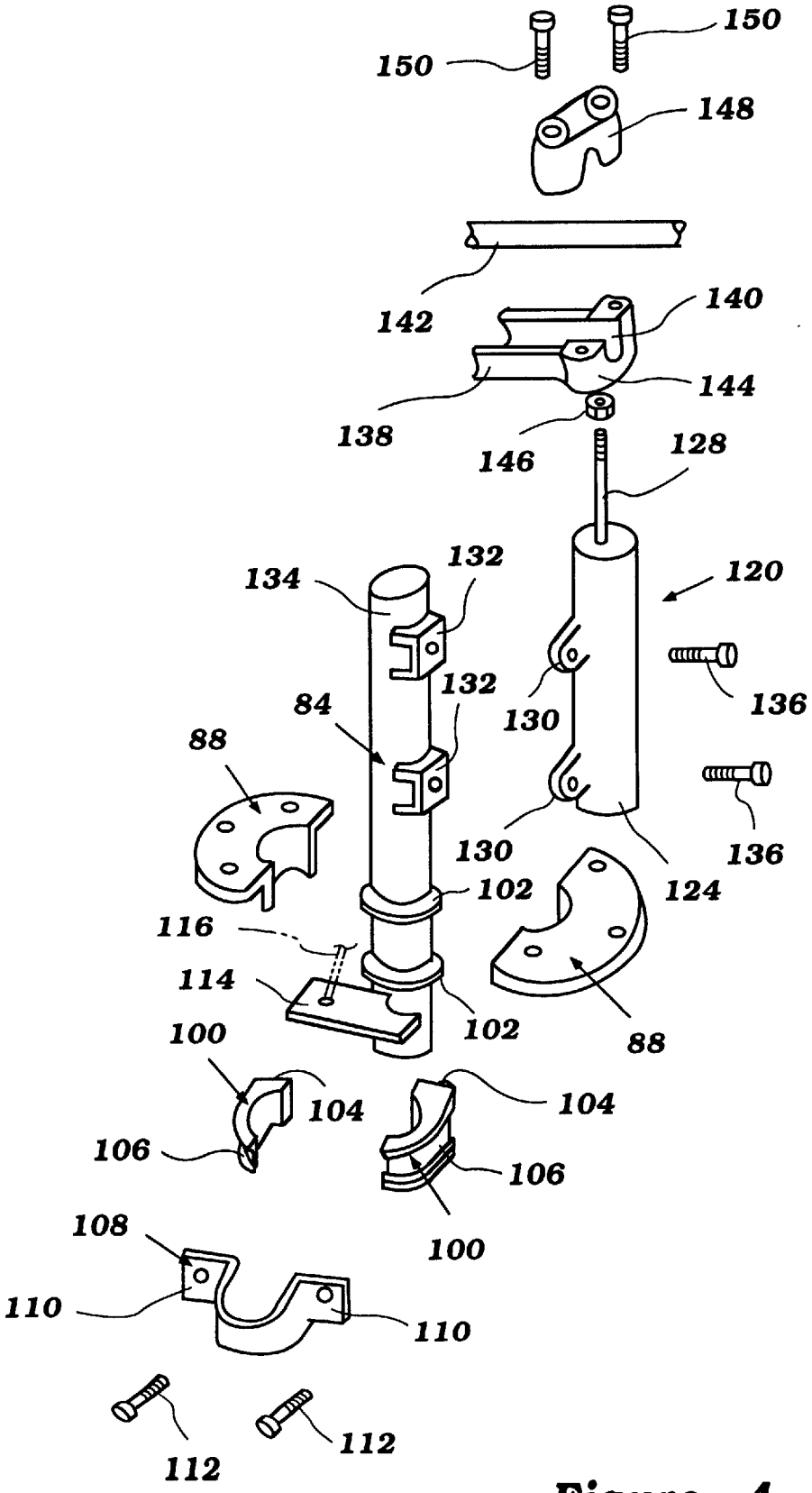
FIG. 4 is an exploded perspective view of a portion of the cushioning apparatus of FIG. 2.

In the illustrated embodiment, as best seen in FIGS. 2 and 4, an upper bearing assembly 88 includes a bushing member 90 that is circumscribed by an annular support flange 92. The support flange 92 has an outer diameter larger than the diameter of the hole 80 in the lid's platform 78. As best seen in FIG. 4, the upper bearing assembly 88 desirably has a two piece construction in order to ease assembly. The pieces are identical halves of the bushing member and the support flange.

When assembled, the bushing member 90 of the first bearing assembly 88 extends through the platform's hole 80 while the support flange 92 rests atop the inclined platform 78. At least one fastener secures the upper bearing assembly 88 to the lid 64. In the illustrated embodiment, a plurality of bolts 94 pass through corresponding holes formed through the support flange 92 and the lid platform 78. Conventional nuts 96 cooperate with the bolts 94 to tightly hold the upper bearing assembly 88 in place.

A lower bearing assembly 98 involves a bushing 100 that surrounds a portion of the steering column 84 near the column's lower end. The bushing 100 is sized to snugly fit between a pair of thrust flanges 102 that circumscribe the steering column 84. In the illustrated embodiment, the bushing 100 has a two-piece construction formed by identical halves. Each bushing half has a generally C shape with a flat abutment end 104. The inner radius of each bushing half desirably matches the radius of the steering column 84. And as seen in FIG. 4, a band recess 106 extends about the outer sides of the bushing halves.

A band bracket 108 extends about a portion of the lower bearing 98 and fits within the band recess 106. Feet 110 of the bracket 108 as well as the abutment ends 104 of the bushing halves, abut the bearing support plate 82. Fasteners, such as, for example, bolts 112 secure the bracket feet 110 to the support plate 82.

The steering column 84 operates a steering actuator. In the illustrated embodiment, as best seen in FIGS. 2 and 4, a lever 114 projects from a lower end of the steering column 84. An end of a steering cable 116, such as a bowden-wire actuator, is attached to the lever 114 such that rotational movement of the steering column 84 actuates the steering cable 116 in a conventional manner. The bowden-wire actuator in turn moves the steering nozzle 32 to effect directional changes of the watercraft 10. It is understood, however, that the present cushioning apparatus can be used with a steering operator that operates a steering device using other types of steering actuators, such as, for example, those that employ a fly-by wire.

In the illustrated embodiment, the cushioning apparatus operates between the steering column 84 and the steering operator 86. The cushioning apparatus in the present embodiment also takes the form of a parallel shock absorber assembly 118 that support the handlebar assembly 86 at the upper end of the steering column 84.

Each shock absorber 120 of the assembly 118 includes a piston 122 that slides within a cylinder 124. In the illustrated embodiment, the piston 122 acts against a compression spring 126 that lies between the piston 122 and a lower end of the cylinder 124. The spring 126 desirably is attached to both the lower end of the cylinder 124 and the underside of the piston 122 in order to dampen movement of the steering operator 86 (e.g., the handlebar) in both upward and downward directions. In addition, or in the alternative, the shock absorber 120 can include other dampening means, such as, for example, a second spring located between the piston and an upper end of the cylinder and/or a fluid (e.g., hydraulic fluid) that passes between a pair of chambers upon movement of the piston, as known in the art.

An actuator rod 128 extends through a hole formed at an upper end of the cylinder 124 of each shock absorber 120. The lower end is fixed to the piston 122. The rod 128 slides through the cylinder's upper hole upon movement of the piston 122 within the cylinder 124.

As best understood from FIGS. 2 and 4, each cylinder 124 is fixed onto a side of the steering column 84. For this purpose, the cylinders 124 each include at least two lugs 130 with mounting through holes.

The steering column 84 includes at least two bosses 132 on each side of the column 84. The corresponding bosses 132 lie on diametrically opposite sides of the column with the upper bosses 132 being positioned near the upper end 134 of the steering column 84. Both the upper and lower bosses 132 are positioned on portion of the steering column 84 that extends above the lid 64. The spacing between the bosses 132 on each side of the column 84 corresponds with the spacing between the lugs 130 on the shock absorber cylinders 120.

Each boss 132 includes a threaded mounting hole. A bolt 136 passes through each mounting hole of the corresponding lug 130 and threads into the hole on the boss 132 to secure the shock absorber 120 to the steering column 84. When assembled, the shock absorbers 120 are mounted such that a travel axis of each shock absorber piston 120 and rod 128 is generally parallel to the steering axis about which the steering column 84 rotates.

The upper ends of the actuator rods 128 support the steering operator 86. In the illustrated embodiment, the upper ends of the actuator rods 128 support a handlebar bracket 138.

The handlebar bracket 138 includes an arcuate groove 140 that is sized to receive a corresponding cylindrical central portion 142 of the handlebar 86. A pair of bosses 144 flank the ends of the bracket 138. A threaded hole extends into each bracket boss 144 on each side of the groove 140. And as best understood from FIG. 2, a threaded hole is formed on the under side of the bracket 138 beneath the groove 140 and near the ends of the bracket 138.

The handlebar bracket 138 is attached to the actuator rods 128 of the shock absorbers 120 using the lower mounting holes. For this purpose, the ends of the rods 128 are threaded. A locking nut 146 is threaded onto the upper end of each rod 128 and the upper end is then threaded into the corresponding mounting hole of the bracket 138. Once fully inserted, the corresponding locking nut 146 is tightened against the handlebar bracket 138 to inhibit rotation of the rod 128 relative to the bracket 138.

Figure 3:
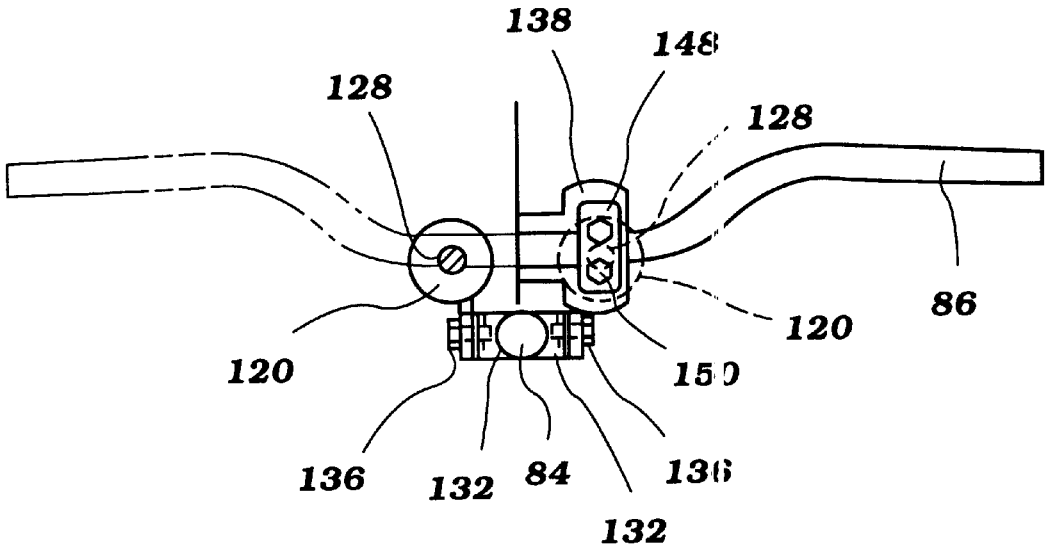
FIG. 3 is a partial sectional, top plan view of a handlebar assembly of the cushioning apparatus of FIG. 2, illustrating a supporting shock absorber assembly with the handlebar shown in phantom.

As best seen in FIGS. 2 through 4, a pair of caps 148 secure the handlebar 86 to the bracket 138. The caps 148 sit atop the bracket bosses 144 and snugly fit over the upper side of the handlebar central portion 142. Fasteners, such as bolts 150, secure the caps 148 to the bracket 138. When the bolts 150 are fully tightened, the caps 148 compress the handlebar 86 against the bracket 138 to prevent rotation and lateral (i.e., side to side) movement of the handlebar 86.

A console cover 152 surrounds the bracket 138 and handlebar central portion 142 to protect the rider. The console cover 152 also can support a variety of indicators, such as, for example, a speedometer, a temperature gauge and like indicators, to indicate the operating condition of the watercraft engine 38. In addition, the handlebar assembly 86 can carry a variety of controls of the watercraft 10, such as, for example, a throttle control, a start switch and a lanyard switch.

The assembled handlebar assembly 86 lies on the rear side of the steering column 84 and is symmetrically positioned about the steering axis, as seen in FIG. 3. The shock absorbers 120 thus allow the handlebar assembly 86 to move up and down along an axis that is parallel to the axis of the steering column 84 and that generally coincides with the steering column axis.

The direct connection between the handlebar 86 and the steering column 84 provided by the shock absorbers 120 transfers rotational movement of the handlebar assembly 86 to the steering column 84 in order to steer the watercraft 10. At least a substantial portion of any impact forces applied to the watercraft hull 12, which often are experienced as the watercraft travels over a body of water, however, are not fully transferred to the handlebar assembly 86 in order to improve the comfort to the rider. The shock absorbers 120 also absorb at least a portion of the relative movement between the rider and the watercraft 10, especially when landing the bow of the watercraft hull on the water during jumps or similar maneuvers.

FIGS. 5 through 8 illustrate a personal watercraft with another embodiment of the cushioning apparatus. Most of the basic components of the watercraft are the same between the embodiments of FIGS. 1–4 and 5–8, except for the cushioning apparatus and a few components of the upper deck. In order to case the reader's understanding, like reference numerals are used to indicate like components between these embodiments. The following first describes the modified upper deck and then addresses the cushioning apparatus of this embodiment.

Figure 5:
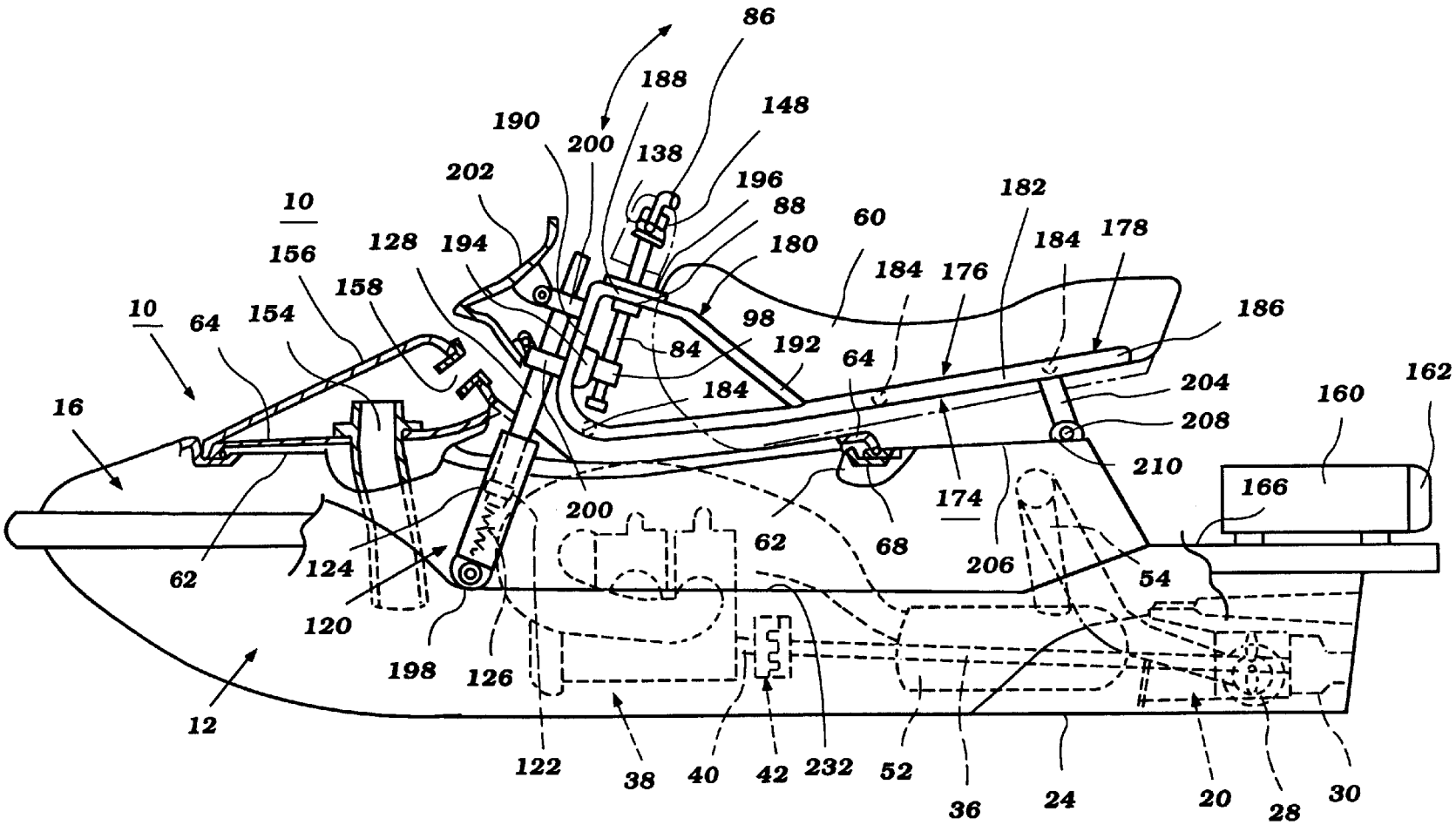
FIG. 5 is a partial sectional side elevational view of a personal watercraft including a cushioning apparatus configured in accordance with another preferred embodiment of the present invention.
Figure 6:
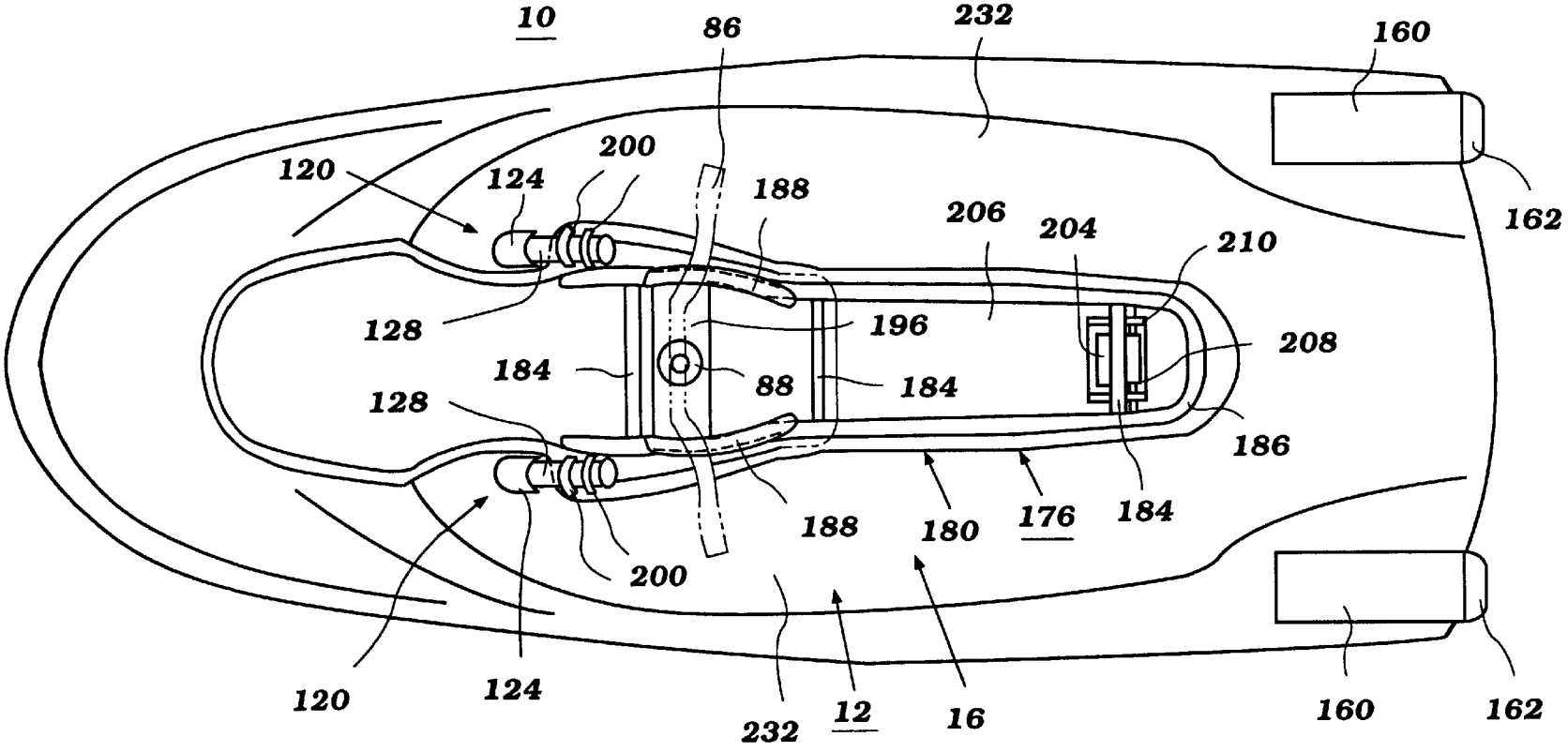
FIG. 6 is a top plan view of the personal watercraft of FIG. 5 with a seat of a rider assembly removed.

As seen in FIG. 5, the lid 64 includes at least one inlet air duct 154 through which air can enter the hull 12. An upper end of the duct 154 projects above the surrounding surface of the lid 64 to inhibit water flow through the duct 154. In addition, a cover 156 extends above an upper end of the air duct 154. A rear facing opening 158, which is offset from the upper end of the duct 154, provides an air passage into the space defined between the cover 156 and the lid 64.

Figure 8:
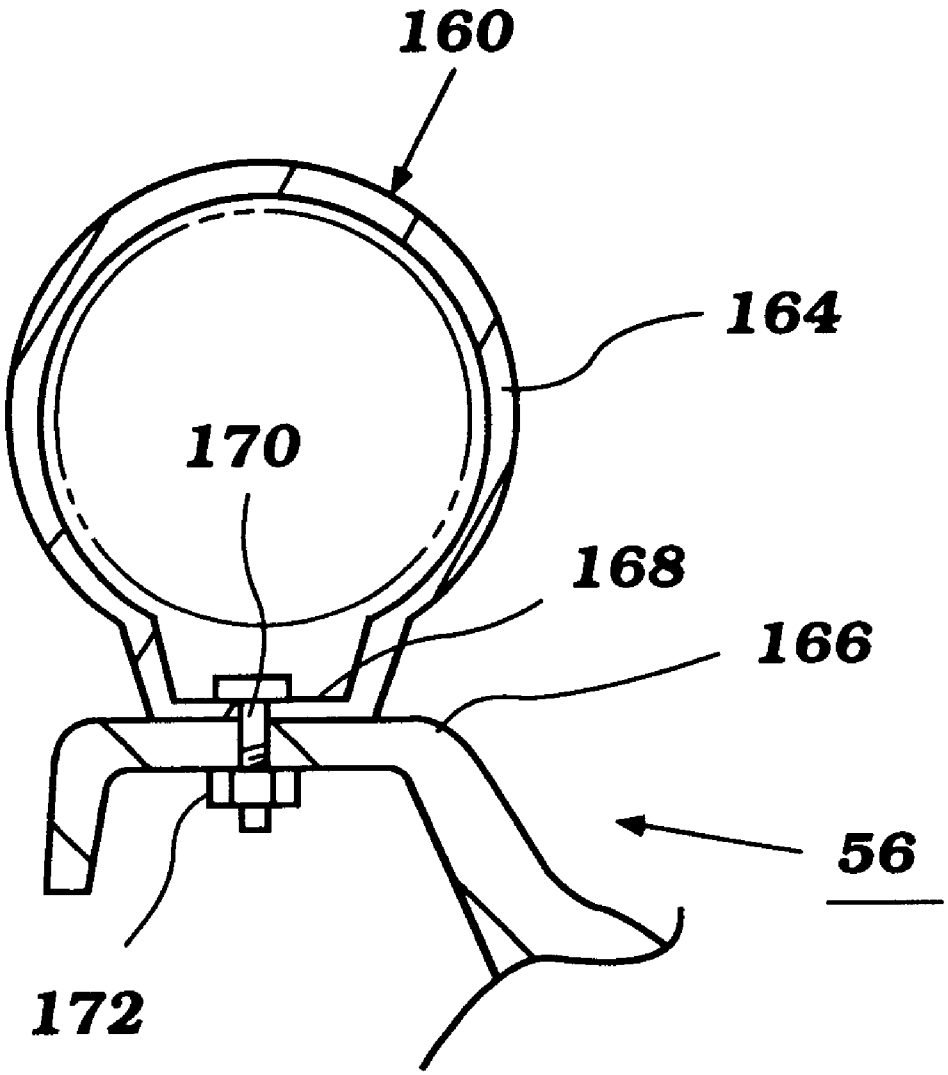
FIG. 8 is a cross-sectional view of one of the aft storage containers illustrated FIG. 7.

The watercraft includes at least one and desirably two storage containers 160 secured to the upper deck 16. In the illustrated embodiment, the containers 160 have hollow, cylindrical shapes with a closed front end. A removable cover 162 seals closed the rear end. As schematically illustrated in FIG. 8, each container 160 is sized to contain small objects 164.

The containers 160 desirably are attached to an upper surface 166 of each raised gunnel 56 of the upper deck 16 at the aft end of the watercraft 10. The containers 160 each include a footing 168 that sits flush against the corresponding gunnel surface 166. A fastener, such as, for example, a bolt 170, extends through aligned holes in the footing 168 and gunnel upper surface 166, and a nut 172 is threaded onto an opposite end of the bolt 170, beneath the upper surface 166, to secure the container 160 to the gunnel 56.

As best seen in FIG. 5, the cushioning apparatus comprises a suspension system 174 that supports a rider assembly 176 on the hull 12. The rider assembly 176 principally includes a frame that supports a seat 60 and a steering operator 86. The rider assembly 176 also desirably is sized to accommodate an operator, and possibly one or two passengers.

Figure 7:
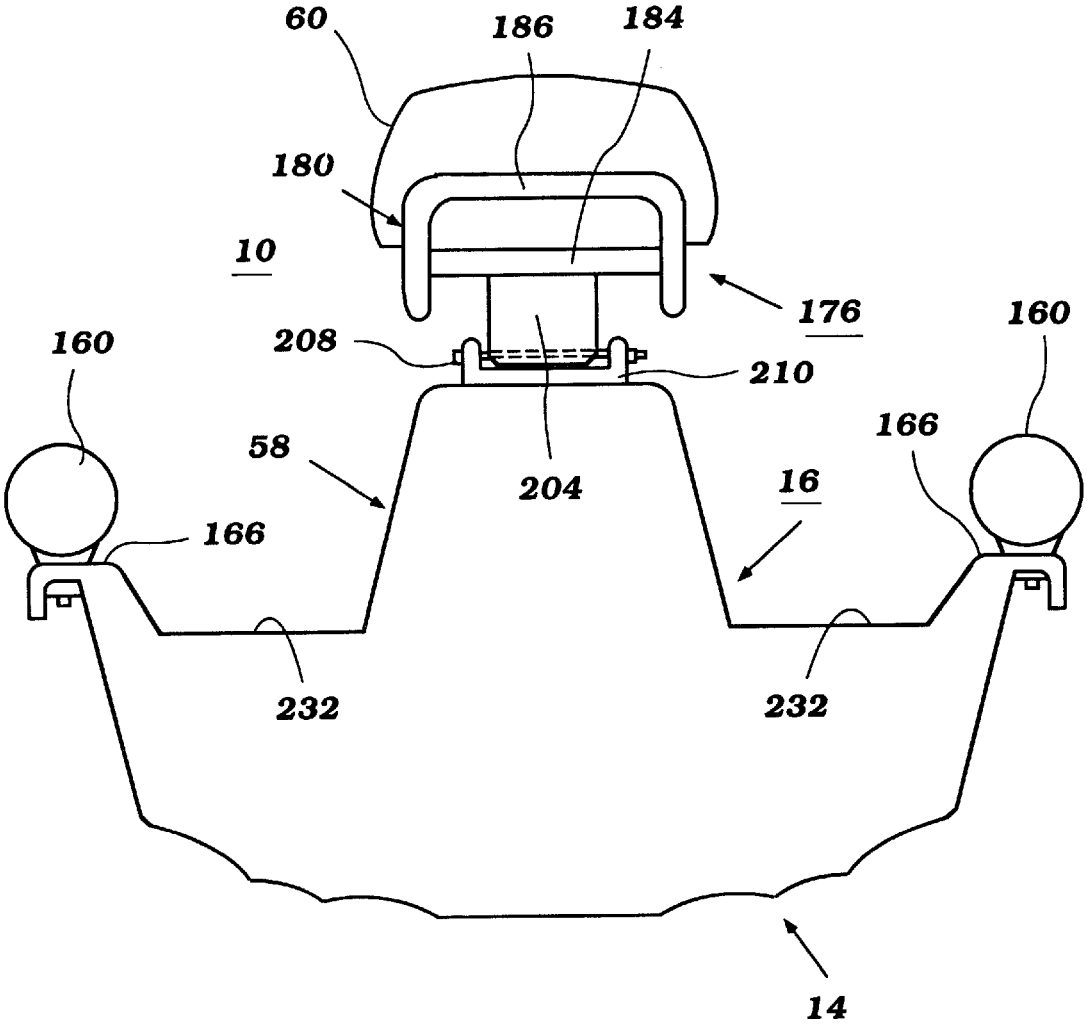
FIG. 7 is a rear elevational view of the personal watercraft of FIG. 5, illustrating in aft storage containers of the watercraft.

The frame of the rider assembly includes a base frame 178 and a steering column frame 180. The base frame 178 is formed by a pair of longitudinally extending rails 182 which are spaced apart by a distance that is a little smaller than the width of the seat 60. A plurality of support ribs 184 extend between the rails 182. An aft rib 186 has a curvilinear shape that extends above a plane in which the rails 182 lie to form a grip at the rear of the seat 60, as best seen in FIG. 7.

The steering column frame 180 is attached to the front end of the base frame 178 and is formed in part by a pair of side pieces. The side pieces have identical shapes and extends to a point above the base frame 178. Each side piece also includes an upper leg 188 supported by a front leg 190 and a rear truss 192. A front brace 194 extends between the front legs 190 and a top brace 196 extends between the upper legs 188 of the side pieces to stabilize and reinforce the steering column frame 180. The braces 194, 196 also support the steering column 84.

A pair of bearing assemblies 88, 98 support and journal the steering column 84 on the frame 180. The upper and lower bearings 88, 98 are similar to the bearing assemblies described above. The upper bearing assembly 88 is secured to the upper brace 196 with the bushing member 90 inserted in a corresponding hole in the upper brace 196. The retainer band 108 is secured to the front brace 194 to support the lower bearing assembly 98 thereon.

The steering column 84 includes a pair of thrust flanges 102 which capture and act against the lower bearing assembly 98. A steering lever 114 projects to the side of the steering column 84 at a lower end of the column 84. The lever 114 operates a steering actuator 116, as described above.

The upper end 134 of the steering column 84 extends upward through the upper bushing assembly 88 and the upper brace 196 to support the steering operator 86. In the illustrated embodiment, the steering operator 86 is a handlebar assembly; however, as noted above, other types of steering operators can be used as well. The upper end 134 of the steering column 84 is fixedly attached to the handlebar bracket 138. Caps 148 secure the handlebar 86 to the bracket 138 and a console cover 152 surrounds the entire coupling.

The seat 60 of the rider assembly 176 lies directly behind the handlebar assembly 86. The seat 60 is secure to the frame 178 by conventional means. The sides of the seat 60 desirably extend below an upper surface of the raised pedestal 58 of the upper deck 16 in order to cover the rails 182 and at least a portion of the side pieces of the steering column frame 180, for aesthetic purposes. The seat 60 also is cushioned to improve the rider's comfort.

The present suspension system 174 provides the rider assembly 176 with two degrees of freedom relative to the hull 12. The front end of the rider assembly 176 can move in the vertical direction, generally parallel to a steering axis, as well as can rock fore and aft. The suspension system 174, however, desirably is stiffer in the fore and aft direction than in the vertical direction in order to prevent substantially free movement of the rider assembly in this direction.

In the illustrated embodiment, the suspension system 174 includes a front shock absorber assembly 120 that includes a pair of parallel shock absorbers 118. Each shock absorber 120 has a similar structure to the shock absorbers described above, but with a heavier construction.

The shock absorbers 120 are mounted within the hull 12 of the watercraft 10 with an upper end of each actuator rod 128 extending through a corresponding aperture formed in the lid 64. A lower end of each shock absorber 120 is pivotally connected to the hull 12 to rotate about a support pin 198.

The upper ends of the actuator rods 128 support the front end of the rider assembly frame 176. In the illustrated embodiment, a pair of support brackets 200 extend forward from both sides of the frame 180. The first pair of support brackets 200 fixedly attach one side of the frame 180 to the actuator rod 128 of the corresponding shock absorber 120, and the second pair of support brackets 200 fixedly attach the other side of the frame 180 to the actuator rod 128 of the other shock absorber 120.

A front cover 202 is attached to eyelet lugs that are formed on the front side of each support bracket 200. The cover 202 surrounds and protects the upper ends of the shock absorber rods 128, as well as the associated coupling between the shock absorbers 120 and the frame 180 of the rider assembly 176.

A rear support of the suspension system pivotally connects the rear end of the rider assembly 176 to the hull upper deck 16. In the illustrated embodiment, as best seen in FIGS. 5 and 7, the support includes a strut 204 that is pivotally attached to a penultimate support rib 184 of the base frame 178 that lies near the rear end of the frame 178. The lower end of the strut 204 is pivotally connected to an upper surface 206 of the raised pedestal 58 by a extending hinge pin 208. A bracket 210, which is attached to the pedestal's upper surface 206, supports the hinge pin 208 on the pedestal 58. In the illustrated embodiment, the hinge pin 208 extends laterally (i.e., in a direction perpendicular to the longitudinal axis of the watercraft 10) and is supported above a base of the bracket 210 by a pair of lugs. The hinge pin 208 passes through aligned holes in the bracket lugs and in the lower end of the strut 204 to couple the strut 204 to the bracket 210. Conventional fasteners, such as e-rings, maintain the hinge pin 208 in this position.

The pivotal connection at the lower ends of the shock absorbers 120 and at the ends of the strut 204 form a parallel linkage system that permits the rider assembly to rock fore and aft on the hull about the hinge pin 208. The front shock absorbers 120 also allow the front end of the rider assembly 176 to move up and down. Accordingly, the suspension system 174 permits the front end of the rider assembly 176 to move along the arcuate path illustrated in FIG. 5. The relative movement of the rider assembly 176 relative to the hull 12 cushions the ride of the watercraft 10. In addition, the shock absorbers 120 absorb at least a portion of any impact forces experienced by the hull 12 as the watercraft 10 travel over the body of water on which it is operated.

Importantly, the suspension system 174 does not weaken the watercraft hull 10. The upper deck 16 and lower hull section 14 directly attach together to complete the hull 12. The suspension system 174 supports the rider assembly 176 on the hull 12 without sacrificing the hull's integrity.

Figure 9:
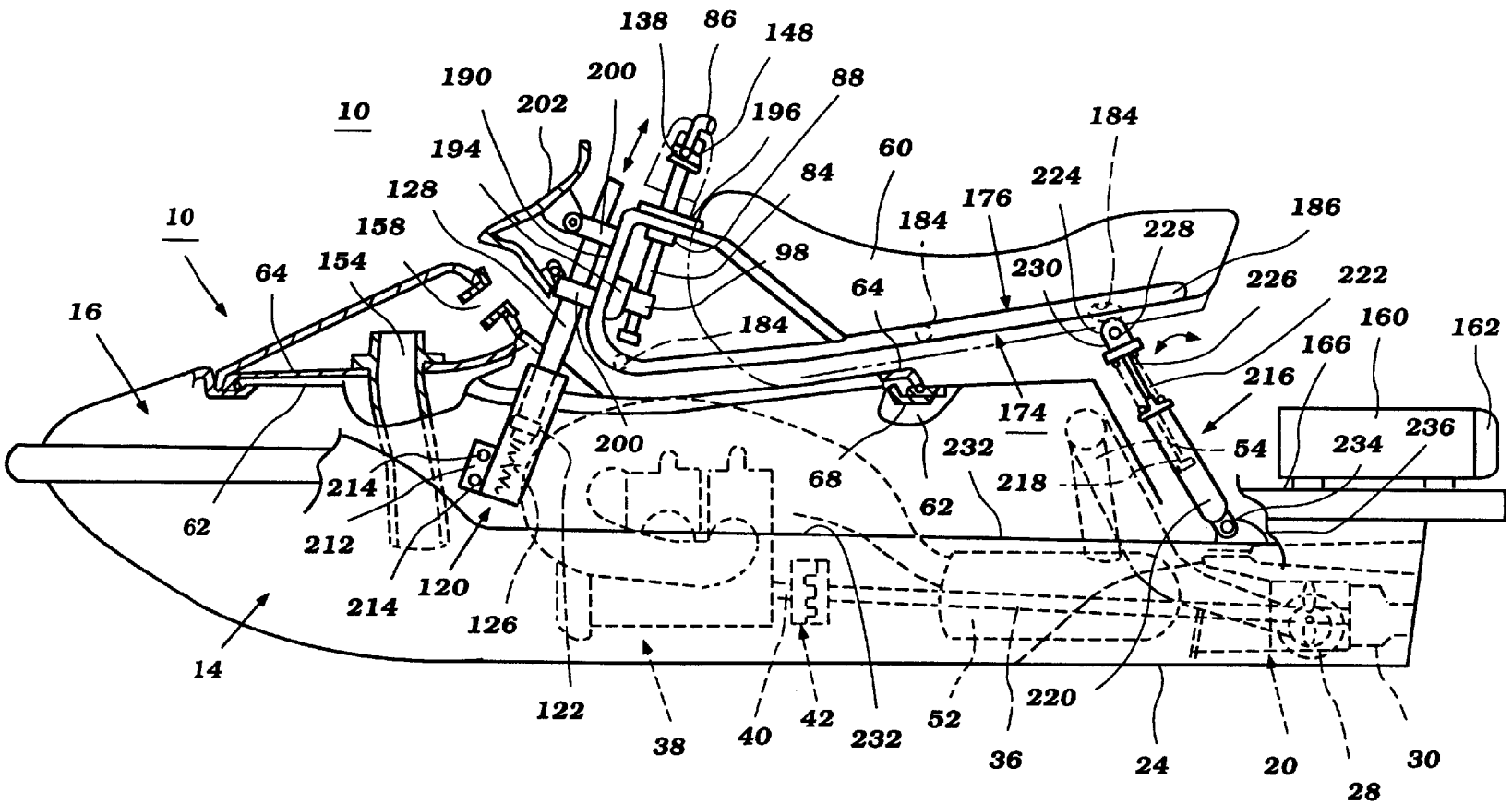
FIG. 9 is a partial sectional side elevational view of a personal watercraft including a cushioning apparatus configured in accordance with an additional preferred embodiment of the present invention.
Figure 10:
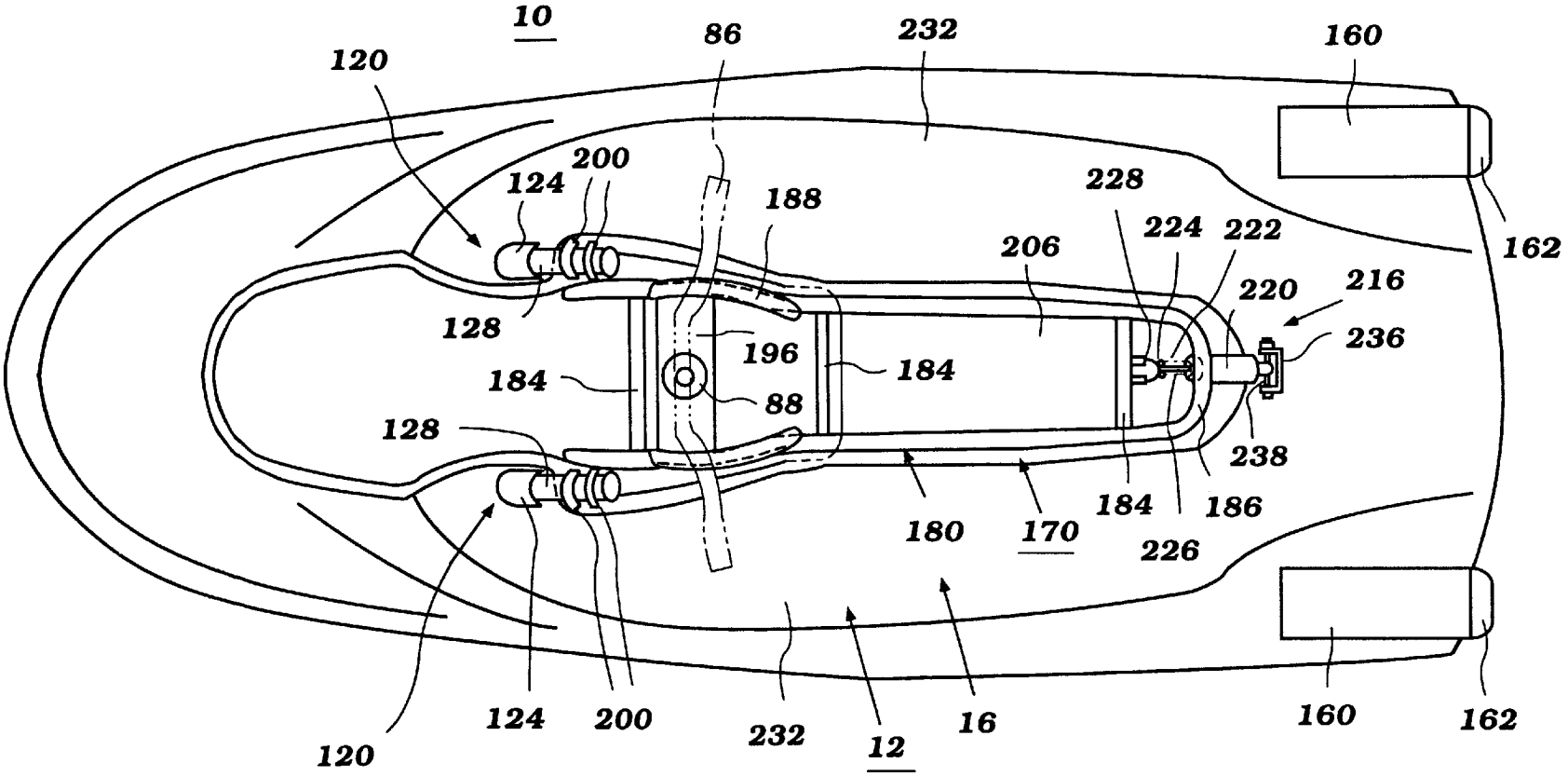
FIG. 10 is a top plan view of the personal watercraft of FIG. 9 with a seat of a rider assembly removed.

FIGS. 9 and 10 illustrate an alternative form of the suspension system 174 of the cushioning apparatus. Again, consistent references numerals will be used for similar components between the embodiments.

As seen in FIG. 9, the shock absorbers 120 are fixedly attached to the hull 12 in this embodiment. A mounting flange 212 projects from the lower end of each shock absorber 120. Fasteners 214, such as, for example, bolts, secure the mounting flange 212 to the hull 12. The fixed attachment of the shock absorbers 120 on the hull 12 restrict movement of the front end of the rider assembly 176 to an up and down movement generally in a direction parallel to the steering axis, as schematically illustrated in FIG. 9.

The rear support of the suspension system 174, which supports the aft end of the rider assembly 176, includes a shock absorber 216 in this embodiment. As best seen in FIG. 10, the shock absorber 216 is positioned such that an actuation axis of the shock absorber 216 lies within a central plane of the watercraft 10 that also contains the longitudinal center lines of the rider assembly 176 and the watercraft hull 12.

The shock absorber 216 includes a piston 218 that operates within a cylinder 220 and acts against a fluid (e.g., air or hydraulic fluid) within the cylinder 220 in a conventional manner. An actuator rod 222 extends from the shock absorber cylinder 220 and supports a mounting bracket 224 at the outer end of the rod 222. The mounting bracket 224 includes an eyelet. A spring 226 operates between the mounting bracket 224 and the end of the cylinder 220 through which the actuator rod 222 extends.

The upper and lower ends of the shock absorber 216 are pivotally connected between the rider assembly 176 and the hull 12. In the illustrated embodiment, the mounting bracket 224 is positioned between a bracket 228 attached to the cross rib 184 of the rider assembly frame 176. A hinge pin 230 provides a pivotal coupling between the mounting bracket 224 on the upper end of the actuator rod 222 and the bracket 228 on the frame 176. Conventional fasteners, such as e-rings, maintain the hinge pin 230 in this position.

The lower end of the cylinder 220 is pivotally connected to an aft deck portion of the upper surface 232 by a horizontally extending hinge pin 234. A bracket 236, which is attached to the deck surface 232, supports the hinge pin 234 on the upper deck 16. In the illustrated embodiment, the hinge pin 234 extends laterally (i.e., in a direction perpendicular to the longitudinal axis of the watercraft 10) and is supported above a base of the bracket 236 by a pair of lugs. The hinge pin 234 passes through aligned holes in the lugs and in the lower end of the cylinder 220 to couple the cylinder 220 to the bracket 236. Conventional fasteners, such as e-rings, maintain the hinge pin 234 in this position.

Figure 11:
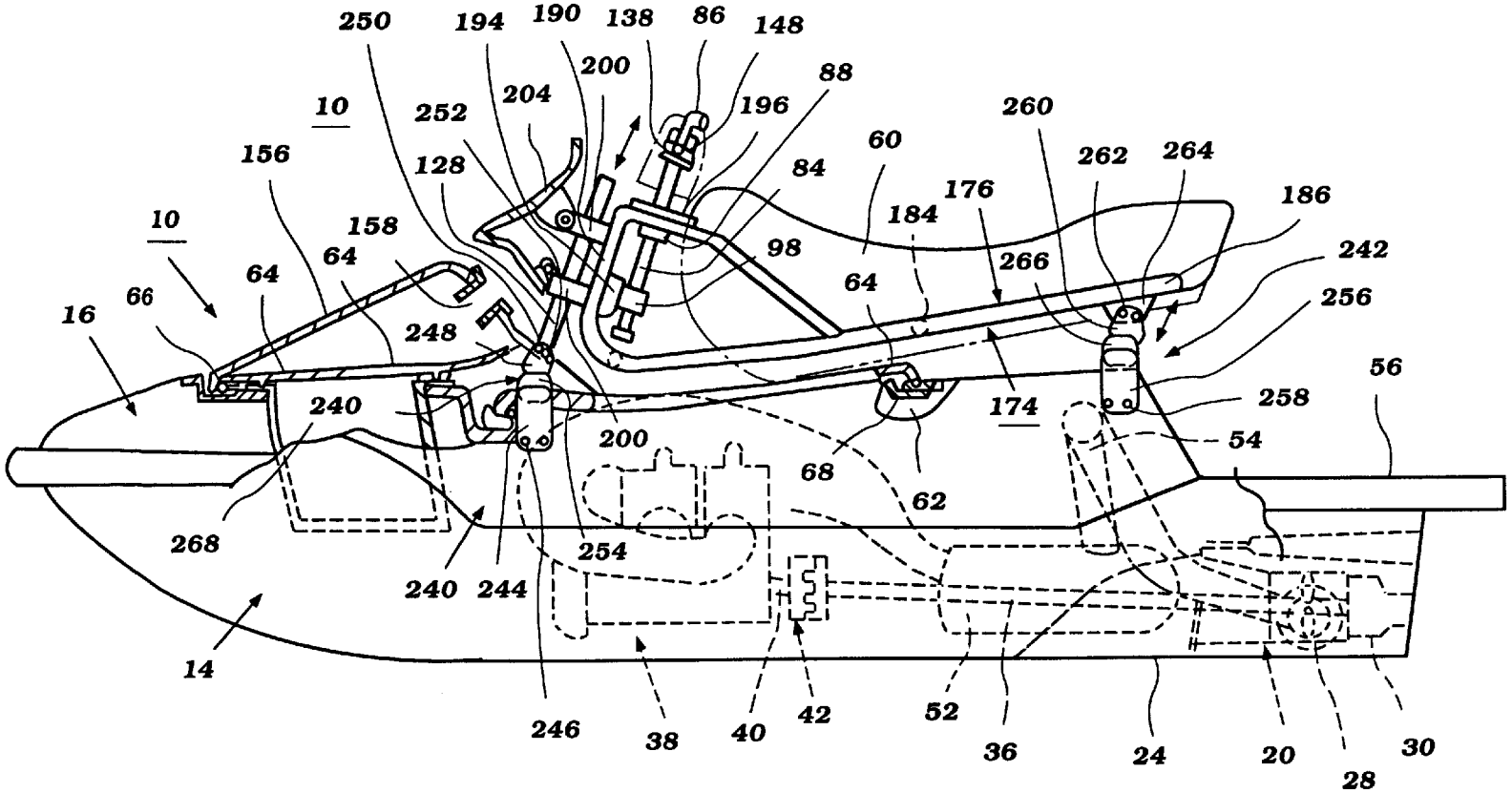
FIG. 11 is a partial sectional side elevational view of a personal watercraft including a cushioning apparatus configured in accordance with a further preferred embodiment of the present invention.
Figure 12:
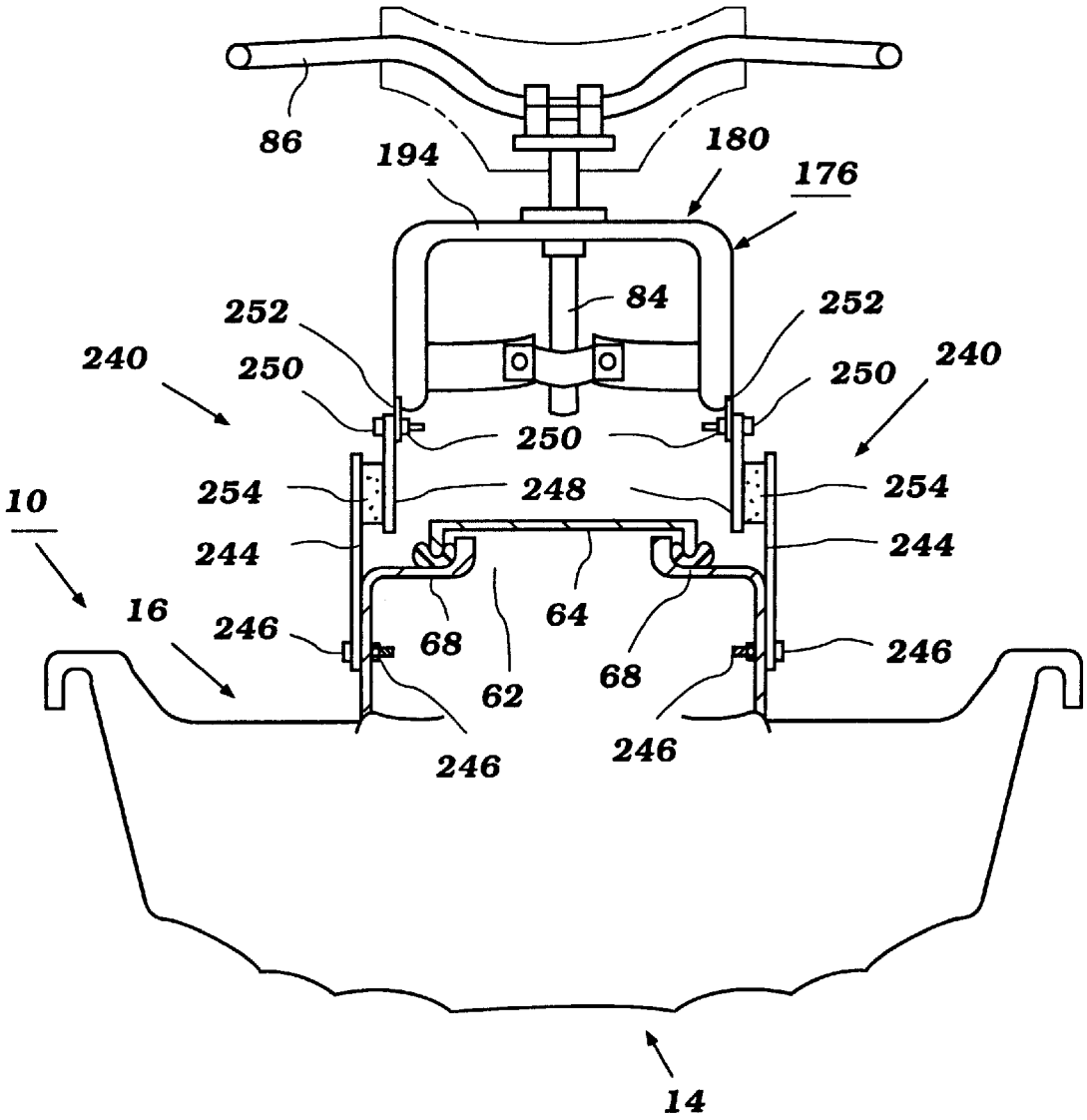
FIG. 12 is a sectional view of a front portion of the cushioning apparatus of FIG. 11.
Figure 13:
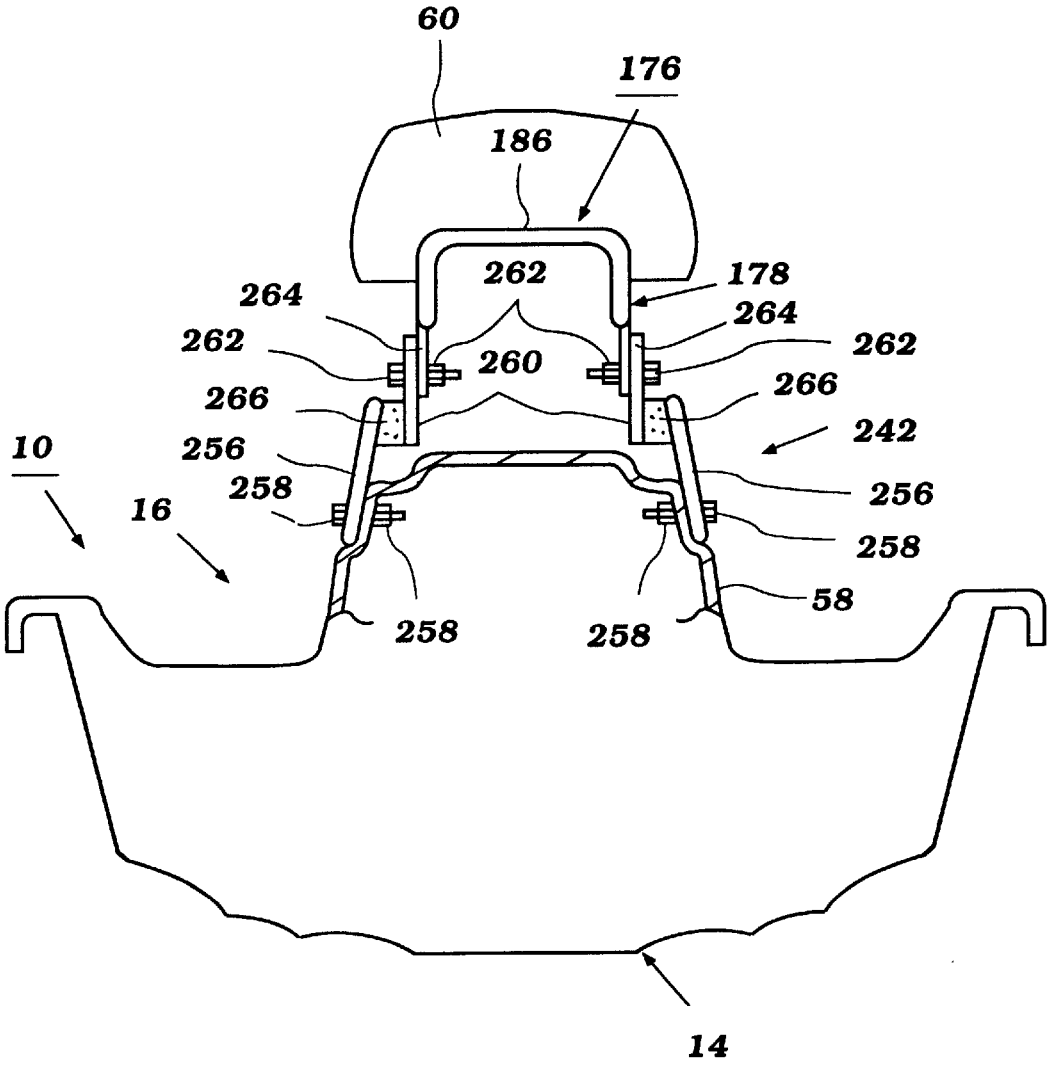
FIG. 13 is a sectional view of a rear portion of the cushioning apparatus of FIG. 11.

FIGS. 11 through 13 illustrate an additional embodiment of the suspension system. The suspension system 174 involves a front linkage and a rear linkage 240, 242. Both the front and rear linkages 240, 242 includes parallel links. The front linkage 240 is principally located within the hull 12 beneath the steering column 84 and the rear linkage 242 lies beneath the aft end of the seat 60, essentially between the raised pedestal 58 and the rider assembly 176.

As best seen in FIG. 12, the front linkage 240 includes parallel lower arms 244 that are fixed to an upper end of the raised pedestal 58 of the upper deck 16. In the illustrated embodiment the arms 244 extend upward in a generally vertical direction. Conventional fasteners 246, nuts and bolts, secure the lower arms 244 to the upper deck 16.

A pair of parallel upper arms 248 of the parallel links depend from the front end of the rider assembly frame 178. The upper arms 248 lie inside the corresponding lower arms 244 of the front linkage 240. Conventional fasteners 250 (e.g., nuts and bolts) secure the upper arms to lower lugs 252 of the rods 128 attached to the frame 180.

A rubber coupling 254 joins together each corresponding upper end of the lower arm 244 and the lower end of the upper arm 248. The rubber couplings 254 provide suitable strength to support the front end of the rider assembly 176, even with at least one rider aboard, while effectively decoupling the rider assembly 176 from the hull 12 to inhibit the transfer of vibrations from the hull 12 to the rider assembly 176. The rubber couplings 254 also provide a degree of vertical travel to the front end of the rider assembly 176, as schematically illustrated in FIG. 11.

The rear linkage 242 has a similar structure to the front linkage 240. The rear linkage includes parallel lower arms 256 that are fixed to an upper aft end of the raised pedestal 58 of the upper deck 16. In the illustrated embodiment the arms 256 extend upward in a generally vertical direction. Conventional fasteners 258, e.g., nuts and bolts, secure the lower arms 256 to the upper deck 16.

A pair of parallel upper arms 260 of the parallel links depend from the rider assembly frame 180 at a point near the aft end of the frame 180. The upper arms 260 lie inside the corresponding lower arms 256 of the rear linkage 242. Conventional fasteners 262 (e.g., nuts and bolts) secure the upper arms 260 to lower lugs 264 of the frame 178.

A rubber coupling 266 joins together each corresponding upper end of the lower arm 256 and the lower end of the upper arm 260. As similar to the front rubber couplings 254, the rubber couplings 266 of the rear linkage 242 provide suitable strength to support the rear end of the rider assembly 176, even with at least one rider aboard, while effectively decoupling the rider assembly 176 from the hull 12 to inhibit the transfer of vibrations from the hull 12 to the rider assembly 176. The rubber couplings 266 also provide a degree of vertical travel to the rear end of the rider assembly 176 to further cushion the ride of the watercraft.

As seen in FIG. 1, this arrangement of the suspension 174 also provides enough space forward of the front linkage 240 to fit a storage container 268. The storage container 268 is located within the hull 12 below the lid 64.

Figure 14:
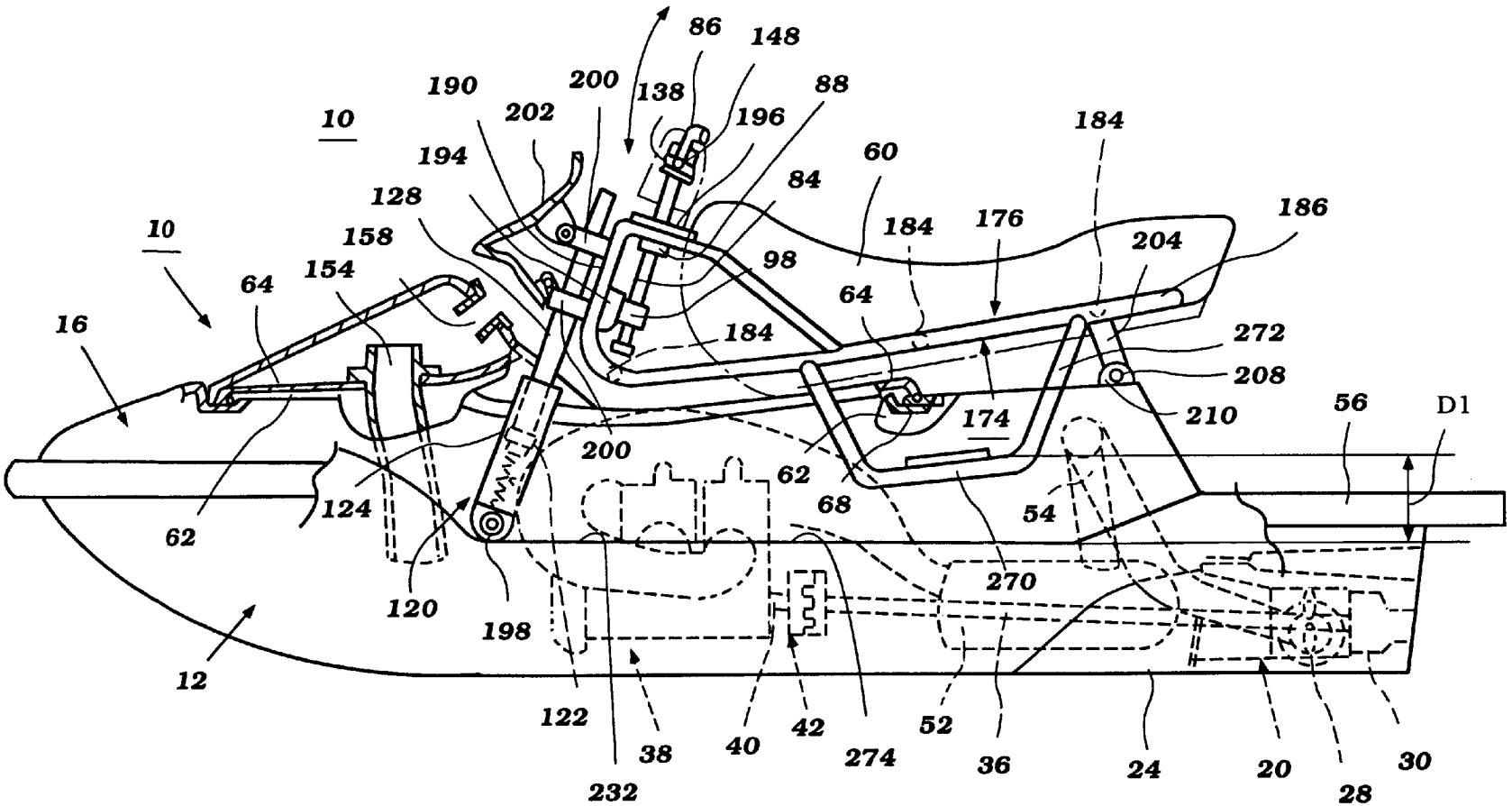
FIG. 14 is a partial sectional side elevational view of a personal watercraft including a cushioning apparatus configured in accordance with another preferred embodiment of the present invention.
Figure 15:
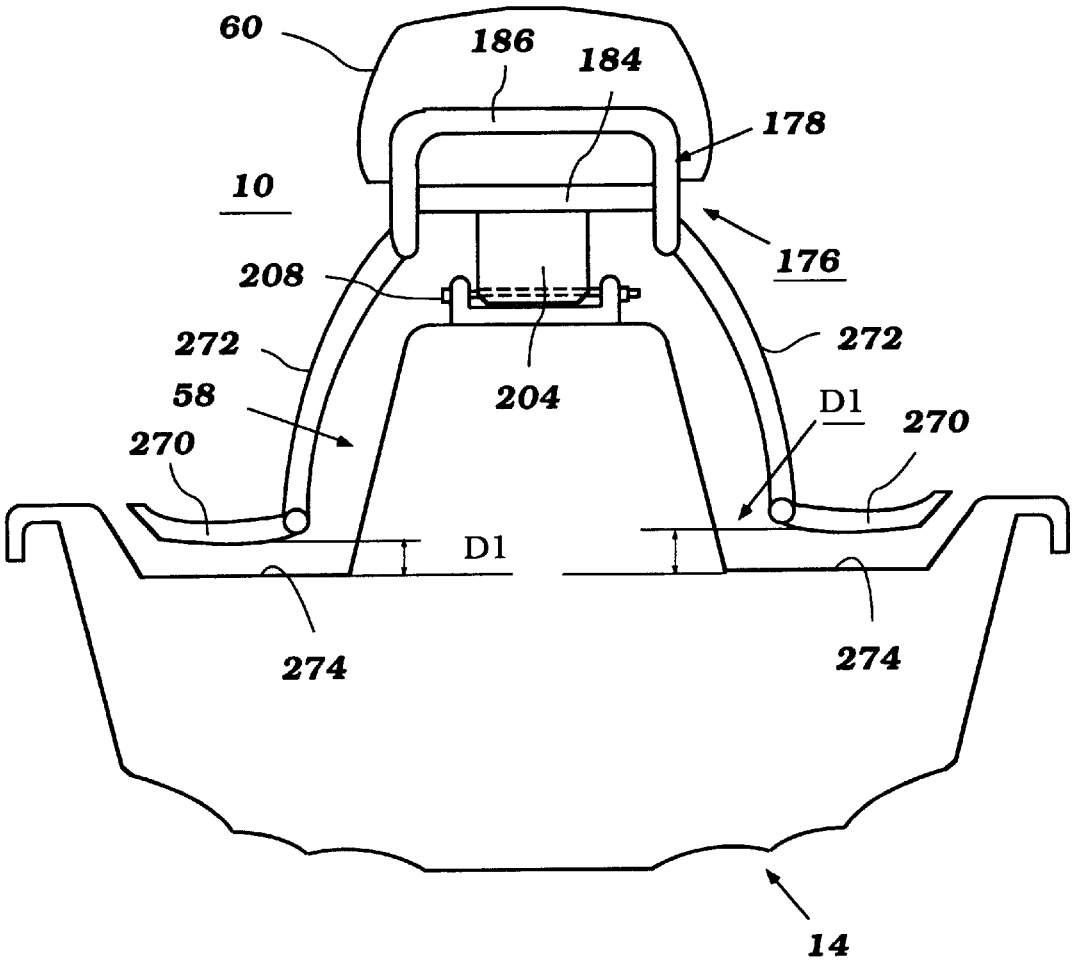
FIG. 15 is a rear elevational view of the personal watercraft of FIG. 14.
Figure 16:
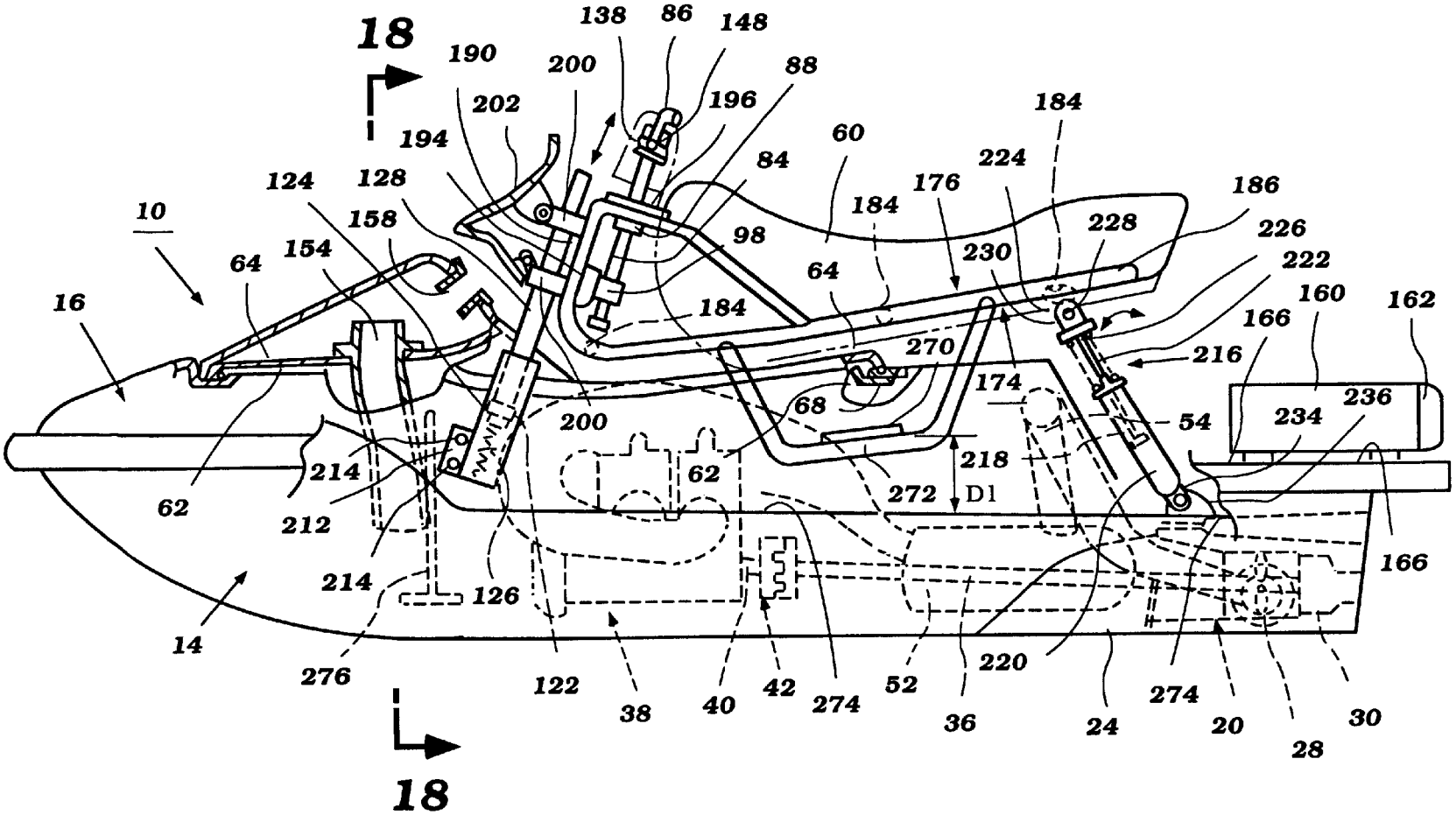
FIG. 16 is a partial sectional side elevational view of a personal watercraft including a cushioning apparatus configured in accordance with an additional preferred embodiment of the present invention.
Figure 17:
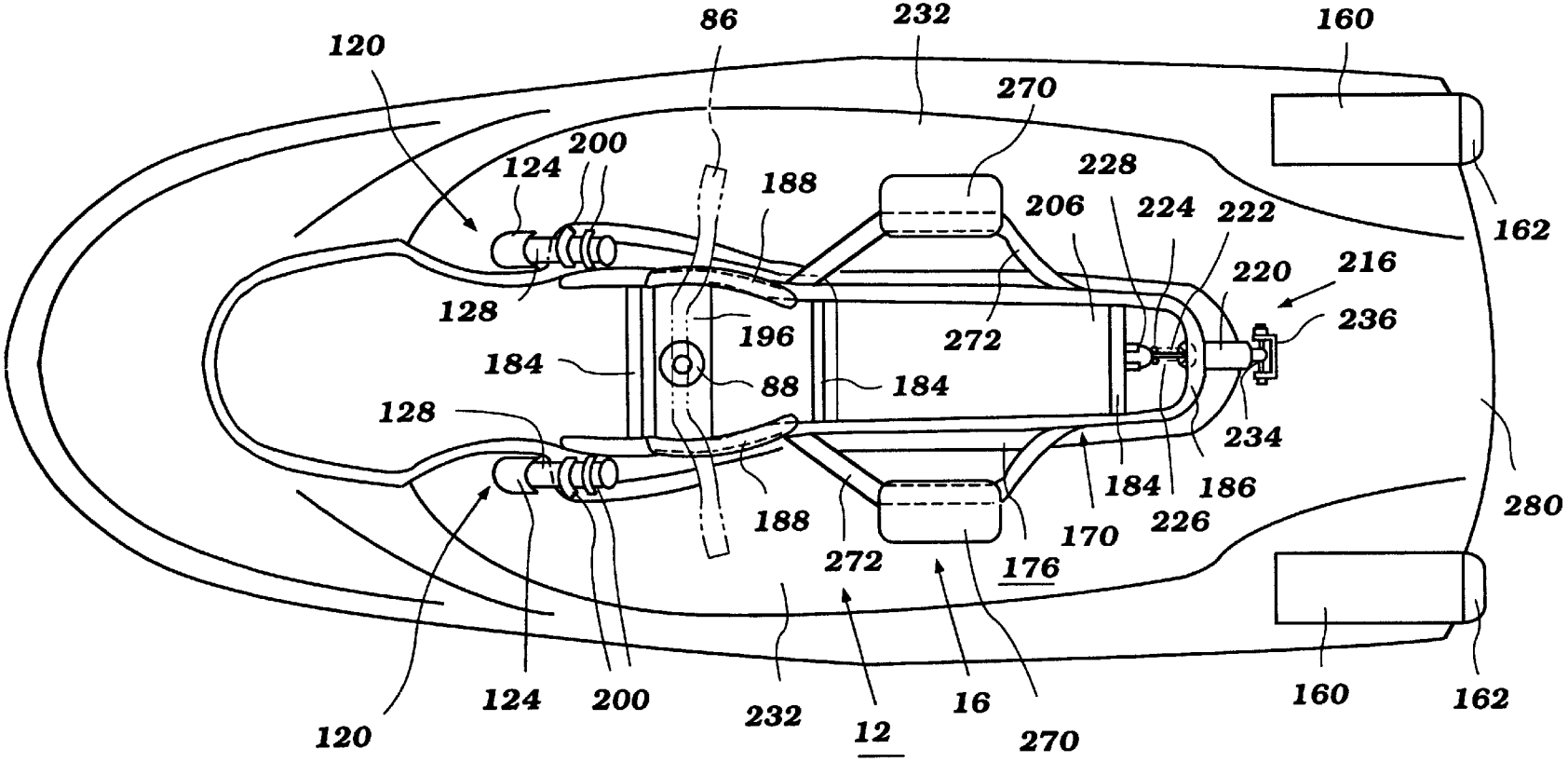
FIG. 17 is a top plan view of the personal watercraft of FIG. 16 with a seat of a rider assembly removed.

FIGS. 14 and 15 disclose another embodiment of a watercraft which is substantially identical to the embodiment of FIG. 5 described above. The present embodiment includes the addition of feet platforms 270 carried by the rider assembly 176. (The containers 160 on the aft end of the watercraft 10 have been omitted to simplify the drawing).

A stirrup frame 272 depends from each side rail 182 of the base frame 178. The stirrup frame 272 lies to the side of the raised pedestal 58 and supports one of the feet platforms 270 at a distance D1 above the foot area 274 of the upper deck 16. The distance D1 desirably is greater than the vertical travel of the rider assembly 176 on the hull 12 in order to prevent contact between the stirrup frame 272/foot platform 270 and the upper deck 16.

Each foot platform 270 desirably is pivotally attached to the corresponding stirrup frame 272. This coupling allow the rider to fold up the foot platform 270 when not in use. Alternatively, the foot platforms 270 can be fixed to the stirrup frames 272 in a generally horizontal orientation.

The foot platforms 270 each have a generally planar shape and curve upward at an outer end of the foot platform 270. The upwardly curved outer end provides the rider with greater leverage to lean the watercraft 10 into a turn.

FIGS. 16 through 19 disclose an embodiment of a personal watercraft with a suspension system identical to that shown and described in connection with FIGS. 9 and 10. The watercraft of the present embodiment also includes feet platforms 270 similar to those described in the preceding embodiment. Accordingly, like reference numerals will be used to indicate like components between the embodiments.

Figure 18:
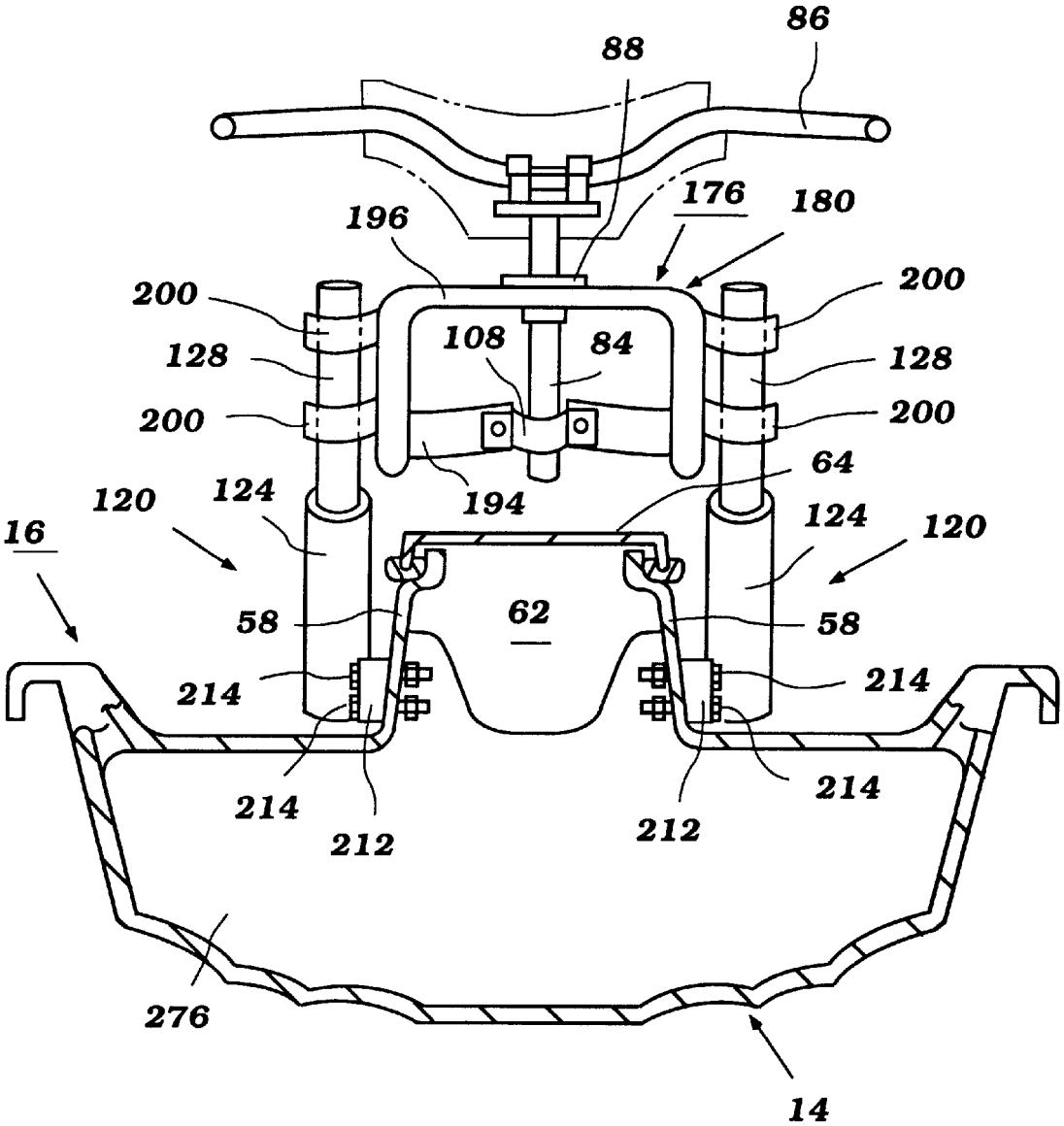
FIG. 18 is a sectional view of the personal watercraft of FIG. 16 along line 18—18 illustrating a handlebar shock-absorber assembly of the cushioning apparatus.

The watercraft 10 advantageously includes a lateral brace 276 that extends between the sides of the hull 12. The brace 276 desirably lies near the point of attachment between the lower ends of the shock absorbers 120 and the hull 12. In the illustrated embodiment, the brace 276 is an internal wall that is integrally formed with the lower hull 14. The internal wall 276 extends laterally between the sides of the lower hull 14 and from a lower surface of the lower hull portion 14 to a point above the peripheral edge of the lower hull portion 14. As best seen in FIG. 18, a portion of the wall 276 extends upward into the area defined by the raised pedestal 58 to strengthen the hull at this location as well. The upper end of the wall 276 can be attached to the upper deck 16 at this location.

The wall 276 lies just forward of the attachment point of the shock absorbers 120 and behind the inlet duct 154. The wall 276 can include one or more apertures to provide a less restrictive air flow from the inlet duct 154 toward the engine 38.

Figure 19:
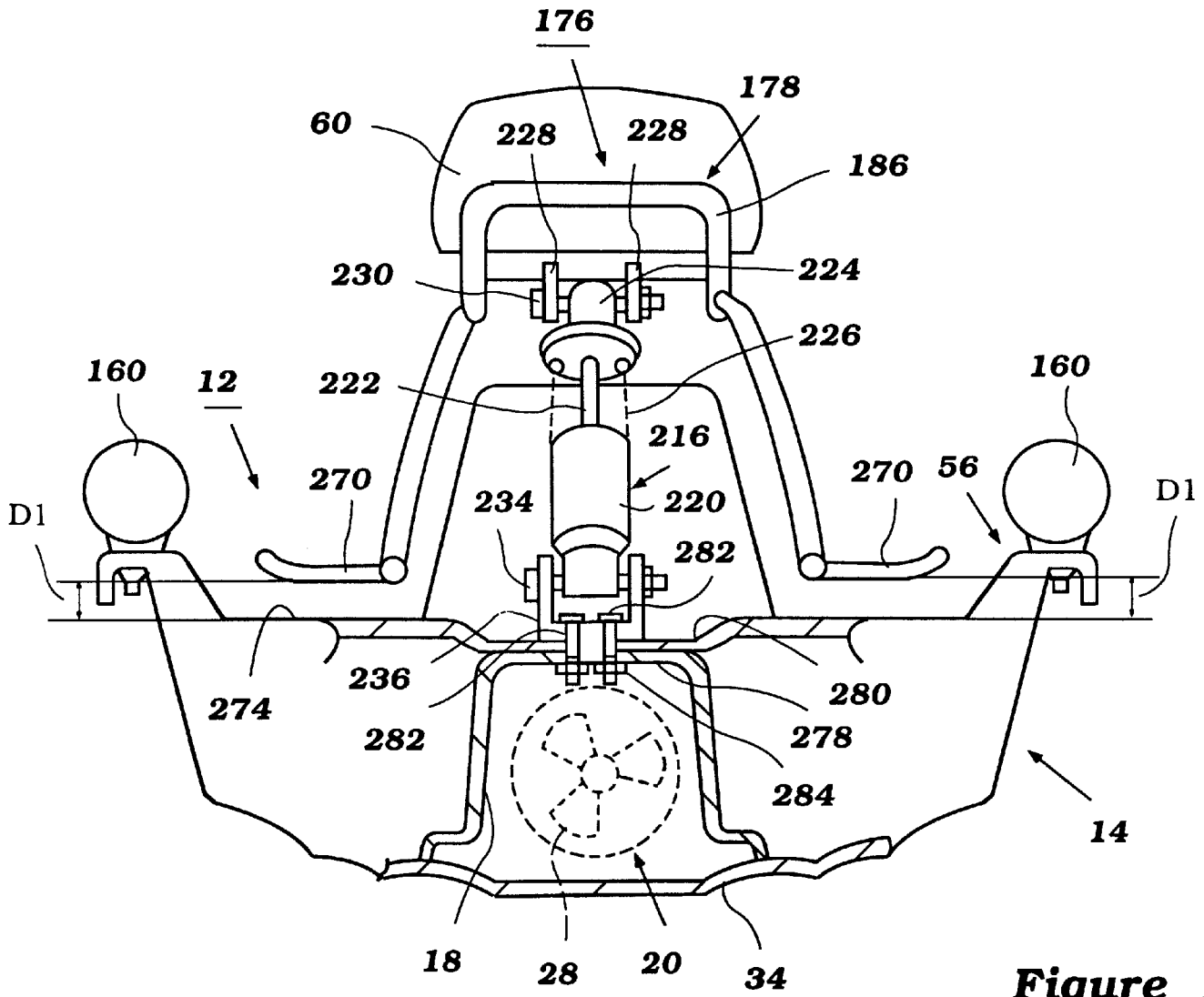
FIG. 19 is a partial sectional, rear elevational view of the personal watercraft of FIG. 16.

The hull 12 of this embodiment also strengthens the point of attachment between the rear shock absorber 216 and the hull 12. As best seen in FIG. 19, the lower hull portion 14 and the upper deck 16 are configured to provide a contiguous, double wall construction at the point of attachment of the rear shock absorber 216 to the hull 12. The lower hull 14 includes an upper wall 278 that forms an upper wall of the tunnel 18. The upper deck 16 also includes a recessed planar aft deck portion 280 the lies directly atop the upper side of the tunnel upper wall 278. The bolts 282 that secure the lower bracket 236 to the upper deck 16 also pass through the upper wall 278 into a space in the tunnel 18 provided above the jet pump unit 20. Nuts 284 secure the lower ends of the bolts 282 in place. The resultant dual wall construction provides a strong location at which to anchor the lower end of the rear shock absorber 216.

As common to each of the embodiments described above, a cushioning apparatus is provided on the watercraft in order to absorb a portion of any impact forces applied to the hull during riding. The cushioning apparatus thus reduces rider fatigue while softening the effects of abrupt turns and jumps.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A small watercraft comprising a hull formed at least in part by an upper deck portion and a lower hull portion, a rider assembly including a support member that supports a steering operator and a seat, said seat being arranged behind the steering operator and being sized to accommodate at least one rider, and a cushioning apparatus positioned generally forward of said seat and arranged between said rider assembly and said hull such that said rider assembly moves relative to a least part of said upper deck portion.

2. A small watercraft as in claim 1, wherein said steering operator comprises a handle bar.

3. A small watercraft as in claim 1, wherein said cushioning apparatus comprises at least one shock absorber.

4. A small watercraft as in claim 3, wherein said shock absorber is arranged between said steering operator and said steering column.

5. A small watercraft as in claim 3, wherein said shock absorber is arranged between said steering operator and said hull.

6. A small watercraft as in claim 5, wherein said hull includes at least one lateral brace that extends between at least the sides of the lower hull portion, and the brace is positioned near the connection between the shock absorber and the hull.

7. A small watercraft as in claim 1, wherein said cushioning apparatus comprises an elastic coupling.

8. A small watercraft as in claim 7, wherein said elastic coupling is arranged between said steering column and said hull.

9. A small watercraft as in claim 9, wherein said cushioning apparatus additionally comprises a first bracket connected to the upper deck portion of the hull and a second bracket supporting in part the steering column, and said elastic coupling joining together said first and second brackets.

10. A small watercraft as in claim 1 additionally comprising a suspension system being arranged to support the rider assembly on the hull, said suspension system including said cushioning apparatus.

11. A small watercraft as in claim 10, wherein said suspension system additionally comprises a support suspending an aft end of the rider assembly above the upper deck of the hull, the support being pivotally connected to both the rider assembly and the upper deck of the hull.

12. A small watercraft as in claim 11, wherein said support includes at least one shock absorber.

13. A small watercraft as in claim 11, wherein said support includes at least one strut.

14. A small watercraft as in claim 11, wherein said support includes at least a first link attached to the upper deck, a second link attached to the rider assembly, and an elastic member joining together said first and second links.

15. A small watercraft as in claim 13, wherein said suspension system is adapted to provide the rider assembly with two degrees of freedom relative to the hull, the rider assembly being movable in a vertical direction and in a fore-and-aft direction relative to the hull, and the suspension being stiffer in the fore-and-aft direction than in the vertical direction.

16. A small watercraft as in claim 10, wherein said rider assembly includes a pair of foot supports which are arranged on opposite sides of the seat and which are suspended above the upper deck of the hull.

17. A small watercraft as in claim 10, wherein said upper deck portion includes an access opening that opens into a space defined between the upper deck portion and the lower hull portion, and the hull additionally includes a removable lid which seals the access opening closed when attached to the upper deck portion.

18. A small watercraft as in claim 14, wherein said cushioning apparatus includes at least one shock absorber.

19. A small watercraft as in claim 18, wherein the shock absorbers are arranged to provide the rider assembly with at least one degree of freedom in a generally vertical direction, whereby the rider assembly moves up and down relative to the hull.

20. A small watercraft as in claim 18, wherein the upper and lower ends of the shock absorber, which is coupled to a fore end of the rider assembly, are fixedly attached to the rider assembly and the hull, respectively, and the upper and lower ends of the shock absorber, which is coupled to an aft end of the rider assembly, are pivotally attached to the rider assembly and the hull, respectively.

21. A small watercraft as in claim 7, wherein the upper end of the shock absorber is connected to the support member and the lower end of the shock absorber is connected to the hull.

22. A small watercraft as in claim 12, wherein the rider assembly is removable attached to the suspension system.

23. A small watercraft as in claim 3 additionally comprising a second cushioning apparatus arranged between said steering operator and said rider assembly.

24. A small watercraft comprising a hull formed at least in part by an upper deck portion and a lower hull portion, a steering operator coupled to a steering column the steering operator being rotatable about a steering axis, and a cushioning apparatus comprised of at least one shock absorber said cushioning apparatus including at least a first member and a second member that is moveable relative to the first member along a travel path that is generally parallel to the steering axis so as to absorb a portion of an impact force applied to the steering operator, wherein said shock absorber is arranged between said steering operator and said steering column, and said first member of said shock absorber includes a cylinder fixed to the steering column, and said second member of said shock absorber includes a piston arranged to move within the cylinder and a rod connected to the piston and projecting out of the cylinder, the rod including an upper end to which the steering operator is attached.

25. A small watercraft as in claim 5, wherein said steering column extends from a space, which is defined between said upper deck portion and said lower hull portion, up through said deck portion, and said cylinder of said shock absorber is fixed to a portion of the steering column that extends above the deck portion of the hull.

26. A small watercraft comprising a hull, a steering operator coupled to a steering column, and a shock absorber arranged between the steering operator and the hull such that the shock absorber absorbs an impact force applied to the steering operator through the hull, and at least one lateral brace that extends between and connects together at least the sides of the hull, the brace being positioned near the connection between the shock absorber and the hull.

27. A small watercraft as in claim 20, wherein said shock absorber is arranged between said steering operator and said steering column.

28. A small watercraft as in claim 20, wherein said shock absorber is arranged between said steering column and said hull.

29. A small watercraft as in claim 20, wherein the steering operator is rotatable about a steering axis, and the shock absorber defines a travel path for the steering operator that is in a direction which is generally parallel to the steering axis.

30. A small watercraft as in claim 20 additionally comprising a rider assembly including the steering operator and a seat positioned behind the steering operator, and a suspension system being arranged to support the rider assembly on the hull, said suspension system including said shock absorber which supports a fore end of the rider assembly.

31. A small watercraft as in claim 27, wherein said suspension system additionally comprises a support suspending an aft end of the rider assembly above the upper deck of the hull, the support being pivotally connected to both the rider assembly and the hull.

32. A small watercraft comprising a hull, a steering operator coupled to a steering column, and a shock absorber arranged between the steering operator and the hull, whereby the shock absorber absorbs an impact force applied to the steering operator through the hull, wherein said shock absorber is arranged between said steering operator and said steering column, and the shock absorber includes a cylinder fixed to the steering column, a piston arranged to move within the cylinder, and a rod connected to the piston and projecting out of the cylinder, the rod including an upper end to which the steering operator is attached.

33. A small watercraft as in claim 22, wherein said steering column extends from a space, which is defined within the hull, to a point above the hull, and said cylinder of said shock absorber is fixed to a portion of the steering column that extends above the hull.

34. A small watercraft comprising a hull defining a channel formed on an underside of the hull which is sized to house at least a portion of ajet propulsion unit of the watercraft, and a planar aft deck portion lying directly above the channel such that at least a section of the aft deck portion is contiguous with a section of the channel, a rider assembly including a steering operator and a seat positioned behind the steering operator, and a suspension system being arranged to support the rider assembly on the hull, the suspension system including at least one shock absorber, the lower end of the shock absorber being attached to the contiguous sections of the channel and the aft deck portion.

35. A small watercraft comprising a hull, a rider assembly including a steering operator and a seat positioned behind the steering operator, and a suspension system being arranged to support the rider assembly on the hull, the suspension system including at least a first shock absorber to support a fore end of the rider assembly, the first shock absorber arranged between the steering operator and the hull such that the first shock absorber absorbs an impact force applied to the steering operator through the hull, and a second shock absorber arranged to suspend an aft end of the rider assembly above the hull, the first and second shock absorbers further being arranged to provide the rider assembly with at least one degree of freedom in a generally vertical direction, whereby the rider assembly moves up and down relative to the hull, and to provide the rider assembly with at least a second degree of freedom in a generally fore-and-aft direction, the shock absorbers being configured so as to be stiffer in the fore-and-aft direction than in the vertical direction.

36. A small watercraft comprising a substantially enclosed hull formed principally by a lower hull and an upper deck, a rider assembly including a steering operator and a seat positioned behind the steering operator, and a suspension system supporting at least a portion of said rider assembly above said hull, said suspension system including a cushioning means for absorbing at least a portion of an impact force applied to said steering operator, said cushioning means arranged adjacent to the steering operator and between the rider assembly and said hull.

37. A small watercraft as in claim 34, wherein the upper deck includes an access opening that opens into a space defined between the upper deck and the lower hull portion, and the hull additionally includes a removable lid which seals the access opening when attached to the upper deck.

38. A small watercraft as in claim 34, wherein the rider assembly includes a pair of foot supports which are arranged on opposite sides of the seat.

39. A small watercraft as in claim 36, wherein the upper deck includes a pair of side platforms which extend along to the sides of at least a portion of the rider assembly, and the foot supports of the rider assembly are positioned above the side platforms of the upper deck.

40. A small watercraft as in claim 34, wherein the cushioning means operates between the hull and a steering column coupled to the steering operator.

41. A small watercraft as in claim 38, wherein the cushioning means is fixedly attached to the hull.

42. A small watercraft as in claim 39, wherein the hull includes a brace that extends between the side walls of the hull in the vicinity of the coupling between the cushioning means and the hull.

43. A small watercraft as in claim 40, wherein the brace includes a laterally extending wall integrally formed within the lower hull portion.

44. A small watercraft as in claim 36, wherein said suspension additionally comprises a support means for suspending a rear end of the rider assembly above the upper deck of the hull and for pivotally connecting the rear end of the rider assembly to the hull.

45. A small watercraft as in claim 42, wherein said support means also is for absorbing a portion of any impact force applied to the rider assembly through the hull.

46. A small watercraft as in claim 35, wherein said access opening extends forward of said seat.

47. A small watercraft as in claim 35, wherein said access opening is located below said steering operator.

48. A small watercraft as in claim 35, wherein said access opening is disposed on the upper deck principally beneath said rider assembly.

* * * * *

UNITED STATES PATENT AND TRADEMARK OFFICE

CERTIFICATE OF CORRECTION

PATENT NO. : 6,019,054
DATED : February 1, 2000
INVENTOR(S) : Hattori et al.

It is certified that error appears in the above-identified patent and that said Letters Patent is hereby corrected as shown below:

In Claim 9, line 26, "as in claim 9" should be --as in claim 8--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*